US010801139B2

(12) United States Patent
Hup Yap et al.

(10) Patent No.: US 10,801,139 B2
(45) Date of Patent: Oct. 13, 2020

(54) SHEARED WOOL FLEECE AND METHOD FOR MAKING SHEARED WOOL FLEECE UTILIZING YARN KNITTING

(71) Applicant: Deckers Outdoor Corporation, Goleta, CA (US)

(72) Inventors: Weng Hup Yap, Penang (MY); Phil Gallant, Carpinteria, CA (US); Jean-Luc Diard, Annecy (FR); Jianjun Chen, Wuxi (CN)

(73) Assignee: Deckers Outdoor Corporation, Goleta, CA (US)

( * ) Notice: Subject to any disclaimer, the term of this patent is extended or adjusted under 35 U.S.C. 154(b) by 257 days.

(21) Appl. No.: 15/880,816

(22) Filed: Jan. 26, 2018

(65) Prior Publication Data

US 2018/0216264 A1 Aug. 2, 2018

Related U.S. Application Data

(60) Provisional application No. 62/451,567, filed on Jan. 27, 2017.

(51) Int. Cl.
*D04B 1/12* (2006.01)
*D04B 15/02* (2006.01)
(Continued)

(52) U.S. Cl.
CPC ..... *D04B 1/123* (2013.01); *D04B 1/02* (2013.01); *D04B 35/34* (2013.01); *D06C 13/08* (2013.01);
(Continued)

(58) Field of Classification Search
CPC ..... D06C 15/02; D06C 13/08; D06C 11/00; D06C 13/00; D06C 15/00; D04B 1/123;
(Continued)

(56) References Cited

U.S. PATENT DOCUMENTS 1,952,407 A 3/1934 Beaty
2,247,308 A 6/1941 Redman
(Continued)

FOREIGN PATENT DOCUMENTS

CN 1091487 A 8/1994
CN 1127811 A 7/1996
(Continued)

OTHER PUBLICATIONS

International Search Report and Written Opinion to corresponding PCT Application No. PCT/US2018/015468 dated May 9, 2018 (12 pages).

(Continued)

*Primary Examiner* — Amy Vanatta

(74) *Attorney, Agent, or Firm* — Greer, Burns & Crain, Ltd.

(57) ABSTRACT

A method of making a sheared wool, deep pile fabric that closely resembles natural sheepskin fleece, that includes forming a yarn made from wool fibers and simultaneously knitting the yarn and a scrim together, where the yarn is attached to and extends from the scrim to form a length of wool pile fabric having natural wool fibers on one side and the scrim on an opposing side. The method includes finishing the wool pile fabric as natural sheepskin by polishing the wool fiber side of the pile fabric by guiding the length of pile fabric over plural heated polishing rolls, where at least two of the plural heated polishing rolls rotate in opposite directions, and cutting the wool fibers to a designated length.

15 Claims, 23 Drawing Sheets

(51) Int. Cl.

| | |
|---|---|
| ***D04B 35/34*** | (2006.01) |
| ***D06C 13/08*** | (2006.01) |
| ***D04B 1/02*** | (2006.01) |
| ***D06C 11/00*** | (2006.01) |
| ***D06C 15/02*** | (2006.01) |

(52) U.S. Cl.
CPC ..... *D06C 15/02* (2013.01); *D06C 11/00* (2013.01); *D10B 2211/02* (2013.01); *D10B 2403/0111* (2013.01); *D10B 2403/0114* (2013.01); *D10B 2501/044* (2013.01)

(58) Field of Classification Search
CPC ..... D04B 1/02; D04B 35/34; D04B 21/14; D04B 1/14; D04B 1/04; D04B 21/04; D04B 1/025; D10B 2403/0114; D10B 2501/044; D10B 2403/0111; D10B 2211/02; D03D 39/24
See application file for complete search history.

(56) References Cited

U.S. PATENT DOCUMENTS

| | | | | |
|---|---|---|---|---|
| 2,395,217 | A | 2/1946 | Ford et al. | |
| 2,496,631 | A | 2/1950 | Leupold et al. | |
| 2,501,435 | A | 3/1950 | Caspe | |
| 2,531,718 | A * | 11/1950 | Rice | D04B 23/08 66/191 |
| 2,586,105 | A * | 2/1952 | Speakman | D06M 13/522 26/19 |
| 2,587,505 | A | 2/1952 | Moody | |
| 2,705,880 | A * | 4/1955 | Kinzinger | D04G 3/02 66/191 |
| 2,712,683 | A | 7/1955 | Gaunt et al. | |
| 2,737,702 | A | 3/1956 | Schmidt et al. | |
| 2,917,807 | A | 12/1959 | Scholl | |
| 2,941,859 | A | 6/1960 | Fein et al. | |
| 2,955,346 | A * | 10/1960 | Walmsley | D03D 27/00 428/89 |
| 3,011,243 | A * | 12/1961 | Herrnstadt | D02G 3/28 66/191 |
| 3,051,544 | A | 8/1962 | Wolf et al. | |
| 3,403,433 | A | 10/1968 | Schoeneberg et al. | |
| 3,477,803 | A | 11/1969 | Fong et al. | |
| 3,575,751 | A | 4/1971 | Mizell | |
| 3,710,462 | A | 1/1973 | Robinson | |
| 3,732,135 | A | 5/1973 | Ernst et al. | |
| 3,809,589 | A | 5/1974 | Kerstetter et al. | |
| 4,340,631 | A | 7/1982 | Endo et al. | |
| 4,381,655 | A | 5/1983 | Trutschel | |
| 4,413,997 | A | 11/1983 | Milligan et al. | |
| 4,415,611 | A | 11/1983 | Yamagata et al. | |
| 4,513,042 | A | 4/1985 | Lumb | |
| 4,636,222 | A | 1/1987 | Pfleiderer et al. | |
| 4,773,135 | A | 9/1988 | Sato et al. | |
| 4,988,551 | A | 1/1991 | Zegler | |
| 5,376,145 | A | 12/1994 | Brady et al. | |
| 5,379,498 | A | 1/1995 | Nielsen et al. | |
| 5,392,499 | A | 2/1995 | Bertoldo | |
| 5,491,857 | A | 2/1996 | Love, III et al. | |
| 5,499,433 | A | 3/1996 | Moghaddassi et al. | |
| 5,553,364 | A | 9/1996 | Nakagawa | |
| 5,566,433 | A | 10/1996 | Love, III et al. | |
| 5,609,935 | A | 5/1997 | Yamagata et al. | |
| 5,645,892 | A | 7/1997 | Whitley et al. | |
| 5,715,707 | A | 2/1998 | Makiyama et al. | |
| 5,893,933 | A | 4/1999 | Strahm | |
| 5,943,746 | A | 8/1999 | Schramayr et al. | |
| 5,966,785 | A | 10/1999 | Catallo | |
| 5,980,579 | A | 11/1999 | Yoon | |
| 6,035,749 | A | 3/2000 | Haselwander | |
| 6,055,709 | A | 5/2000 | Martek et al. | |
| 6,112,381 | A | 9/2000 | Dischler et al. | |
| 6,195,854 | B1 | 3/2001 | Catallo | |
| 6,247,215 | B1 | 6/2001 | Van Alboom et al. | |
| 6,258,129 | B1 | 7/2001 | Dybdal et al. | |
| 6,260,247 | B1 | 7/2001 | Dischler et al. | |
| 6,269,525 | B2 | 8/2001 | Dischler et al. | |
| 6,330,786 | B1 | 12/2001 | Settle | |
| 6,375,685 | B2 | 4/2002 | Payet | |
| 6,634,070 | B2 | 10/2003 | Willauer, Jr. | |
| 6,722,000 | B1 | 4/2004 | Weiner et al. | |
| 6,823,569 | B2 | 11/2004 | Cohen et al. | |
| 6,916,349 | B2 | 7/2005 | Dischler et al. | |
| 6,941,623 | B2 | 9/2005 | Brorens et al. | |
| 7,090,701 | B2 | 8/2006 | Cardamone et al. | |
| 7,146,829 | B1 * | 12/2006 | Su | D04B 9/12 66/92 |
| 7,213,309 | B2 | 5/2007 | Wang et al. | |
| 7,763,324 | B2 | 7/2010 | Frantini et al. | |
| 9,212,440 | B2 | 12/2015 | Crary et al. | |
| 2002/0016134 | A1 | 2/2002 | Hoire et al. | |
| 2004/0214027 | A1 | 10/2004 | Ko | |
| 2006/0225226 | A1 | 10/2006 | Merikowski | |
| 2007/0207286 | A1 | 9/2007 | Craig et al. | |
| 2008/0028582 | A1 | 2/2008 | Lee et al. | |
| 2008/0220201 | A1 | 9/2008 | Wieckowski | |
| 2008/0301920 | A1 | 12/2008 | Chadha | |
| 2008/0302837 | A1 | 12/2008 | Mitsui | |
| 2010/0159771 | A1 | 6/2010 | Fujisawa et al. | |
| 2010/0192338 | A1 | 8/2010 | Tukek | |
| 2012/0263911 | A1 | 10/2012 | Tao et al. | |
| 2013/0255048 | A1 * | 10/2013 | Crary | D06C 11/00 28/162 |

FOREIGN PATENT DOCUMENTS

| | | | |
|---|---|---|---|
| CN | 201389997 | Y | 1/2010 |
| CN | 101979760 | B | 5/2012 |
| EP | 1536047 | A1 | 6/2005 |
| EP | 2534987 | A1 | 12/2012 |
| JP | 08337950 | A | 12/1996 |
| KR | 20-0304205 | | 2/2003 |
| WO | 2016029615 | A1 | 3/2016 |

OTHER PUBLICATIONS

Chinese Office Action for Chinese Patent Application No. 201380002017.4 dated Sep. 30, 2015 and English Translation.

Xiaoguang MA, China Textile & Apparel Press, "Physical and Mechanical Dyeing and Finishing of Textiles", 1st Edition, pp. 219-226, dated Jun. 30, 2002 and English Translation.

* cited by examiner

SHEARED WOOL FLEECE AND METHOD FOR MAKING SHEARED WOOL FLEECE UTILIZING YARN KNITTING

PRIORITY CLAIM

The present non-provisional application claims priority to and the benefit of U.S. Provisional Application No. 62/451,567 filed on Jan. 27, 2017, the entire contents of which is incorporated herein.

BACKGROUND

Sheepskin fleece or natural fleece is the wool of a sheep that is either sheared from one or more sheep or on the wool side of shearling. Shearling is sheepskin or a pelt with wool still on it that is treated on both the fleece side and the skin side. Since natural fleece is an excellent insulator and very soft, it is used in a variety of products including coats, gloves, hats, footwear, rugs and car seat covers.

The cost associated with manufacturing natural fleece products depends on the quality and the availability of sheepskin. The quality of each sheepskin varies based in part on environmental factors. For example, sheep located in regions where there are taller grasses likely have hides that are contaminated by grass seeds. As the sheep walk through the tall grass, the seeds dislodge from the grass and become embedded in the sheep's hide thereby causing scar tissue in the hide. In some instances, the damaged tissue of the hide falls out leaving small holes in the hide after processing. Any damaged tissue that remains on the hide results in imperfections, which reduces the quality of the sheepskin. As a result, the more seeds that are embedded in and contaminate the sheepskin, the lower the quality of the sheepskin.

Because the quality of the sheepskin varies, sheepskin is graded based on whether the sheepskin is a higher quality, i.e., little to no imperfections, or a lower quality, i.e., many imperfections. Higher grades of shearling having acceptable quality on both the fleece side and the skin side are called "twin-face" sheepskin. Shearling that has an acceptable fleece side but an imperfect skin side as described above is referred to as "table grade" sheepskin.

Shearling quality is also limited by the types of sheep that the shearling comes from. Certain types of sheep are more desirable because they produce better quality skins. Also, the number of the quality sheepskins available to manufacture the above products is limited by the number of sheep that are available. As demand for natural fleece products grows, the cost associated with obtaining the sheepskins also grows. Thus, the profits associated with natural fleece products depend largely on the availability of sheepskins.

Accordingly, there is a need for an alternative to natural fleece that replicates the desirable qualities of sheepskin and reduces the costs associated with manufacturing natural fleece products.

SUMMARY

The present disclosure is directed to a sheared wool, natural fleece, deep pile fabric that closely resembles and can be used in lieu of shearling to make a variety of products including but not limited to footwear and apparel products. In very general terms, the present method involves forming a natural wool, deep pile fabric, and then finishing the fabric as if the fabric was natural sheepskin. Wool pile fabrics are known, but are generally unsuitable for use in clothing and footwear because the wool pile is coarse, bristly and abrasive. Accordingly, prior efforts to make artificial fur and shearling products have utilized softer artificial fibers, rather than natural wool fibers. See, e.g., U.S. Pat. Nos. 2,737,702, 3,710,462, 4,415,611 and 4,773,135 which are incorporated herein by reference. However, these artificial fur and fleece products lack the qualities of genuine, natural wool fleece and shearling. The inventors of the present disclosure have developed finishing processes that remarkably achieve a natural wool, deep pile fabric that very closely approximates natural wool fleece and shearling. The fabric is soft, dense and exhibits the same performance characteristics of natural sheepskin fleece.

In an embodiment, the present method of making a sheared wool, deep pile fabric that closely resembles natural sheepskin fleece, includes forming a yarn made from wool fibers and simultaneously knitting the yarn and a scrim together, where the yarn is attached to and extends from the scrim to form a length of wool pile fabric having natural wool fibers on one side and the scrim on an opposing side. The method includes finishing the wool pile fabric as natural sheepskin by polishing the wool fiber side of the pile fabric by guiding the length of pile fabric over plural heated polishing rolls, where at least two of the plural heated polishing rolls rotate in opposite directions, and cutting the wool fibers to a designated length.

In another embodiment, the present method of making a sheared wool pile fabric includes knitting a yarn made with sheared wool fibers to a textile scrim to produce a length of wool pile fabric having a wool fiber pile on one side and the textile scrim on an opposing side, rough shearing the wool fiber side of the fabric to a first predetermined length of the wool fibers, applying a polishing coating to the wool fiber side of the fabric, polishing the wool fiber side by passing the fabric over at least two heated polishing rolls, and fine shearing the wool fiber side of the fabric to a second predetermined length of the wool fibers.

In a further embodiment, the present method of making a wool fleece product includes providing a yarn comprised of sheared wool fibers, and knitting the yarn and a textile scrim to form a length of semi-finished wool pile fabric having a wool pile on one side and the textile scrim on an opposing side. The method further includes rough shearing the wool fleece side of the web to a first length of the wool fibers, polishing the wool pile side by passing the fabric through a first set of at least two polishing rolls heated to at least 170 degrees C., applying a polishing coating to the wool pile side of the fabric, polishing the wool pile side by passing the fabric through a third polishing roll heated to at least 170 degrees C., shearing the wool pile side of the fabric to a second wool fiber length, wherein the second wool fiber length is less than the first wool fiber length, polishing the wool pile side by passing the fabric through at least one additional polishing roll heated to at least 170 degrees C. and shearing the wool pile side of the fabric to a final wool fiber length, wherein the final wool fiber length is less than the second wool fiber length.

DETAILED DESCRIPTION

The present invention provides a method of processing sheared wool and weaving onto a textile base material to make a finished sheared wool product for use in making footwear, apparel and other products.

The sheared wool product formed by the process of the present invention closely approximates natural fleece and can be used in lieu of sheepskin in many applications. In one application, the finished sheared wool product is used to make artificial shearling for use as a liner for footwear, coats, gloves and other products in lieu of natural shearling.

The present disclosure is directed to a sheared wool, natural fleece, deep pile fabric that closely resembles and can be used in lieu of shearling to make a variety of products including but not limited to footwear and apparel products. In very general terms, the present method involves forming a natural wool, deep pile fabric, and then finishing the fabric as if the fabric was natural sheepskin. Wool pile fabrics are known, but are generally unsuitable for use in clothing and footwear because the wool pile is coarse, bristly and abrasive. Accordingly, prior efforts to make artificial fur and shearling products have utilized softer artificial fibers, rather than natural wool fibers. See, e.g., U.S. Pat. Nos. 2,737,702, 3,710,462, 4,415,611 and 4,773,135 which are incorporated herein by reference. However, these artificial fur and fleece products lack the qualities of genuine, natural wool fleece and shearling. The inventors of the present disclosure have developed finishing processes that remarkably achieve a natural wool, deep pile fabric that very closely approximates natural wool fleece and shearling. The fabric is soft, dense and exhibits the same performance characteristics of natural sheepskin fleece.

Figure 12:
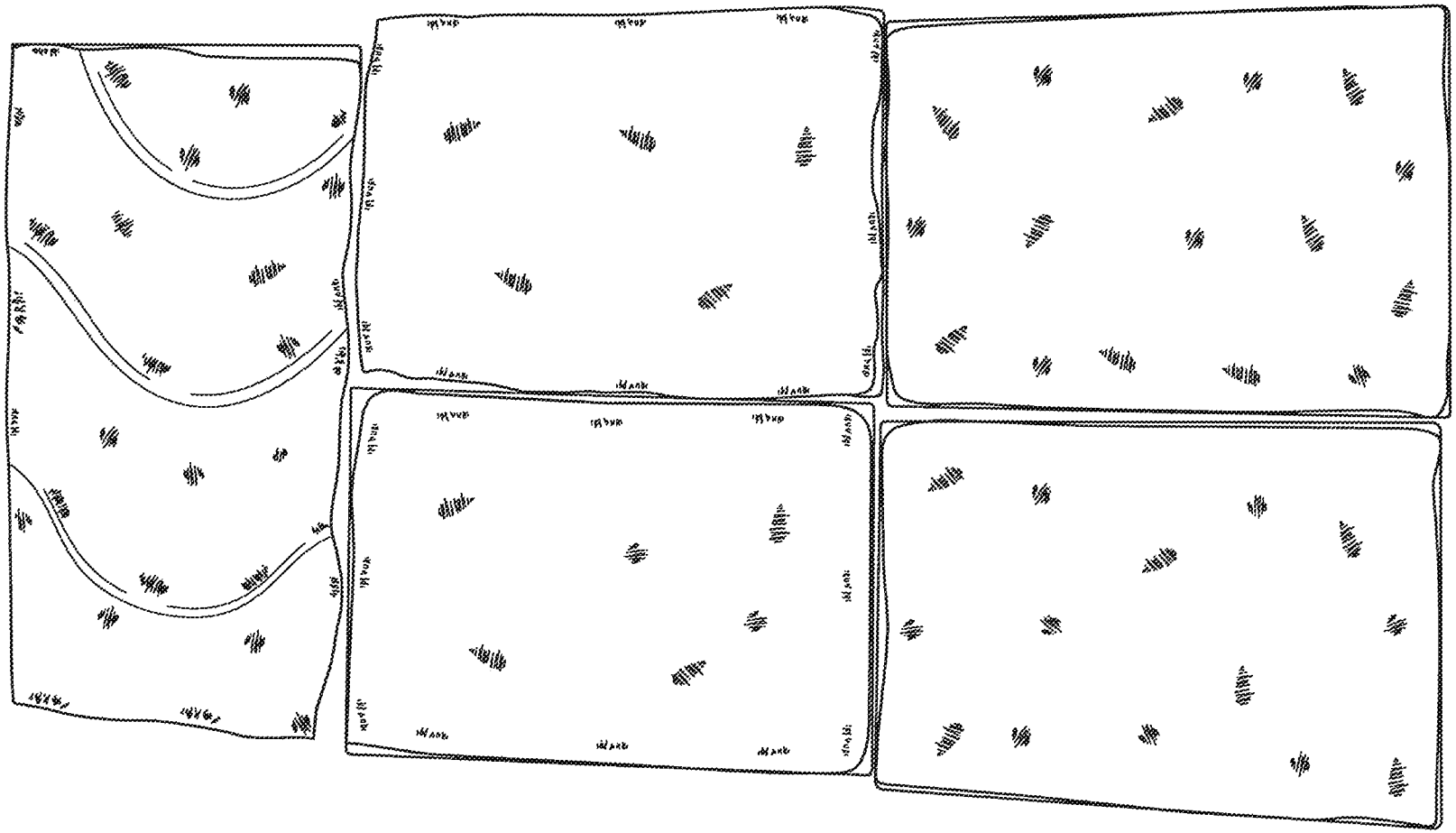
FIG. 12 shows perspective views of a fleece side of the finished wool pile fabric product of the present invention.
Figure 13:
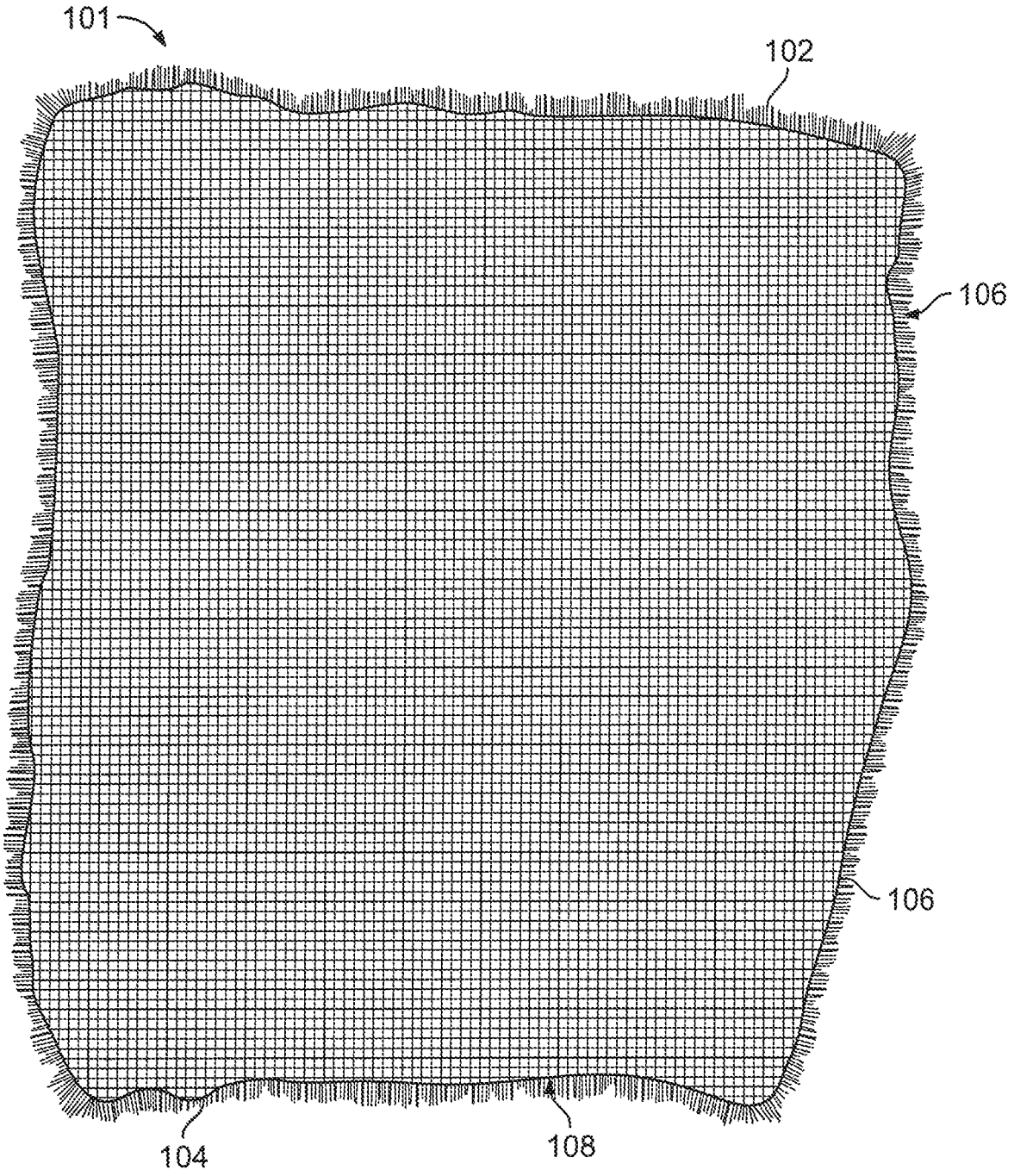
FIG. 13 shows a perspective view of a scrim side of the finished wool pile fabric product of the present invention.

Referring to FIGS. 1-18, the present method for making the sheared wool product includes the following processes: a raw material finishing process 100, a yarn knitting process 200 and an inspection process 300, a pre-finishing process 400, a finishing process 500, a post-finishing process 600 and a storage/shipping process 700 for producing a sheared wool product 102. Examples of the finished sheared wool product 102 (hereinafter referred to as the "final product") are shown in FIGS. 12 and 13.

Figure 2:
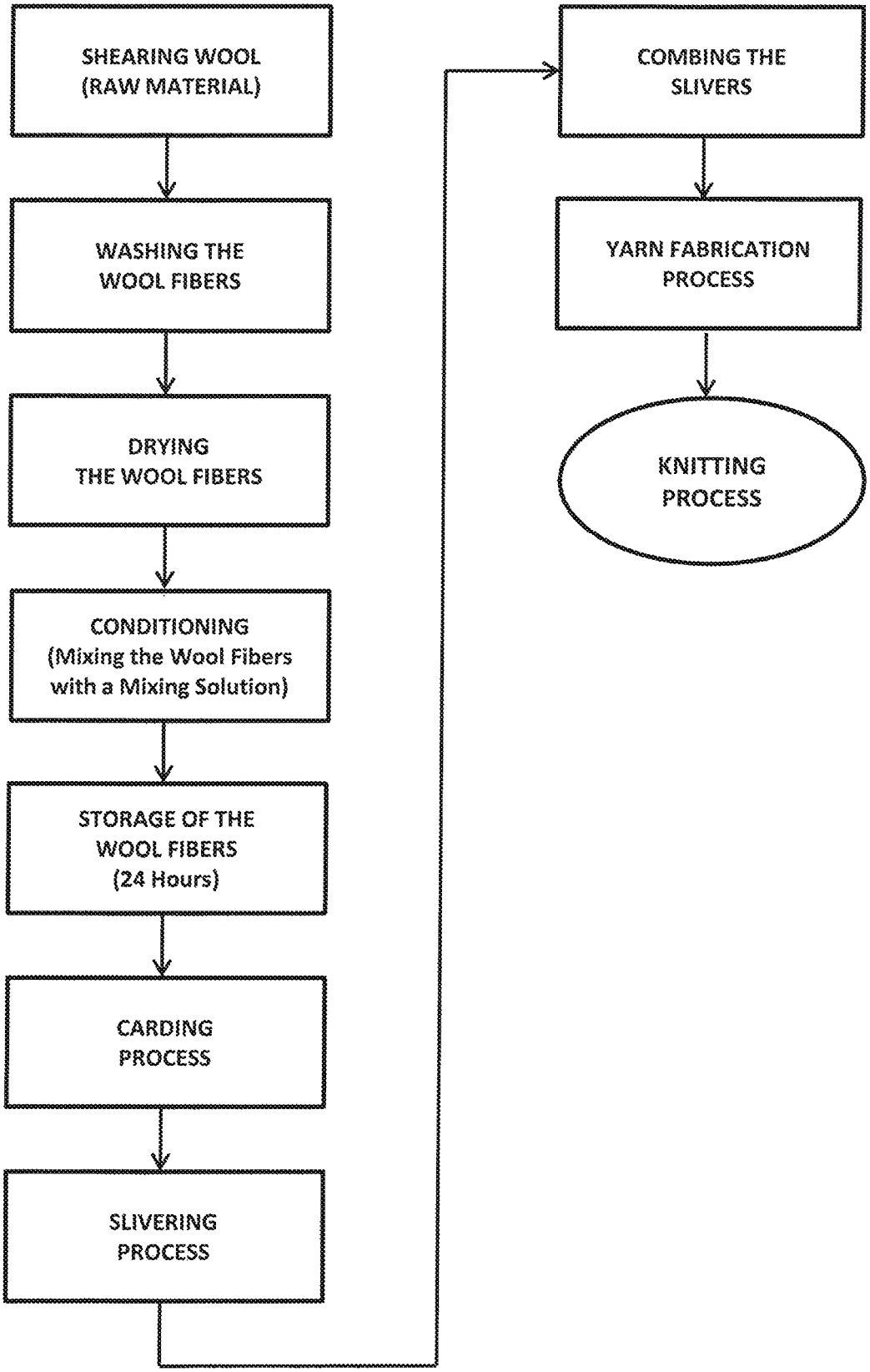
FIG. 2 is a schematic diagram showing the steps for processing the wool fibers and fabricating the wool fiber yarn.

In the raw material finishing process 100 illustrated in FIG. 2, natural wool is sheared from live sheep or from sheepskins or pelts in a shearing step to provide wool fibers. The wool fibers are the natural fibers from sheep that comprise wool used in manufacturing the wool pile fabric. Initially, the wool fibers are cleaned in a washing step to remove impurities such as oils from the sheep's skin, dirt and odor. Specifically, the wool fibers are placed in a cleaning machine that washes the wool fibers using water and suitable cleaning solutions. After being cleaned, the wool fibers are ready for further processing as described below. Alternatively, cleaned wool fibers can be stored in one or more suitable containers, such as a sealed bag or bags, for immediate processing, storage or shipment to another location for processing at a later time.

The cleaned wool fibers 102 may be dyed when a specific color of the final finished wool product 101 is desired. If the wool fibers are dyed after cleaning, the cleaned wool fibers are dyed and dried to change the color of the wool fibers from a non-uniform mix of gray, white and brown colors to a uniform off-white or parchment color that is common in natural fleece products. It should be appreciated that the wool fibers may be dyed to any desired color or combination of colors, including but not limited to, a natural fleece color, blue, gray, white, pink and purple. In the dyeing process, a designated amount of the cleaned wool fibers is placed in a dye vat based on the vat size. Specifically, 400-430 kg of the wool fibers and 3.5-4.0 tons of water (at about 68 to 72° C. for lighter color dyes and about 78 to 82° C. for darker color dyes) are added to the dye vat to fully load the vat and soak the wool fibers. The vat is sealed and the wool fibers 104 are soaked for a designated period of time. The water is then drained from the vat and hot water is supplied to the vat based on the amount of the wool fibers placed in the vat. The water in the vat is then heated to a designated temperature, which in this embodiment is about 70° C. While the water is being heated, a designated amount of ammonia and a softening agent proportional to the amount of water in the dye tank are mixed in a separate stirring tank and a designated amount of water is extracted to melt the dye as described below. In the present method, a ratio of approximately 10 kg of ammonia and 4 kg of the softening agent are mixed with 250 L of water. When the water in the dye vat reaches the designated temperature, the mixture of ammonia and the softening agent are supplied to the vat via an inlet line connected to a suitable pump.

The wool fibers soak in the mixture of water, ammonia and softening agent for at least thirty minutes before the dye is added. During the soaking period, the extracted water is heated to 100° C. and mixed with the dye to melt the dye. After the thirty-minute soaking period, a dye of a selected color, such as natural fleece is added to the vat via an inlet line connected to a pump. The dye mixture and the wool fibers in the vat are agitated for about ninety minutes and then a formic acid solution is added to the vat via the inlet line and pump. Initially, 3 kg of the formic acid solution is added to the vat. After fifteen minutes, an additional 3 kg of the formic acid solution is added to the vat to achieve a ratio of 1:8 formic acid solution to water and the mixture is further agitated for a designated amount of time.

When the dyeing of the wool fibers is complete, the mixing solution is drained from the vat leaving the dyed wool fibers. The vat is then filled with a washing solution including a mixture of water, formic acid and softening agent for washing the fibers. In this embodiment, approximately 2 kg of formic acid and 10 kg of softening agent are added for every 400 kg of the wool fibers in the vat. After washing the wool fibers in the vat, the washing solution is drained and the dyed wool fibers are removed from the vat and inserted into a dehydrator. The dehydrator includes a tank having a screen-type bowl rotatably connected to the tank. The bowl operates similar to a spin cycle of a washing machine where the bowl rotates the wool fibers at a designated number of revolutions per minute (rpm) to remove excess water from the wool fibers. The excess water exits the dehydrator via a drain line attached to the tank. The dehydrated wool fibers are then transported to one or more dryers to dry the wool fibers. In the present embodiment, each dryer includes a first stage having three ovens set at an operating temperature of 130° C., a second stage having two ovens set at an operating temperature of at least 130° C. and a third stage having a cooler oven set at a lower operating temperature that the other ovens to cool the wool fibers. The dried wool fibers exit the dryer or dyers and are wrapped in a bundle by a fabric material using one or more baling machines. Each bundle of the wool fibers weighs approximately 50 kg. It should be appreciated that a colorfast treatment solution may be applied to the wool fibers after being dyed to help preserve or maintain the dyed color. It should also be appreciated that other equipment and processes can alternatively be used for dyeing the wool fiber consistent with this disclosure. Also, alternatively, as described below, a yarn made from the wool fibers or the finished wool pile fabric may be dyed, instead of dyeing the wool fibers at this stage of the process.

After the dyeing and drying step, the wool fibers are conditioned in which a carding-applicator machine untangles and aligns the wool fibers. A conditioning solution is applied including a lubricant and an anti-static agent to the fibers. The wool fibers are subsequently mixed together in two mixers or mixing machines connected in series to evenly distribute the conditioning solution on the wool fibers. The conditioning solution enables the wool fibers to be easily separated and used in subsequent processing steps.

Initially, as described above, a designated batch or batches of the wool fibers are received following the dyeing process. The batch size or weight of each batch is based on production parameters (i.e., the length, width and thickness of the finished wool pile fabric) and wool blend needed to produce the wool pile fabric. Each batch of wool fibers is unwrapped or opened and placed on a metal pan or other suitable surface near an inlet side of the carding-applicator machine. The wool fibers are then manually placed onto an inlet conveyor belt on a first or inlet side of the carding-applicator machine which moves wool fibers toward a pivoting carding arm having metal teeth. The carding arm reciprocates between a non-engaged position and an engaged, carding position in which the carding arm, and more specifically, the teeth on the carding arm contact the wool fibers in a generally parallel direction to the movement of the wool fibers to untangle, clean, intermix and align the wool fibers so that the conditioning solution is applied to a significant percentage of the wool fibers prior to entering the first mixing machine.

The conditioning solution is applied with a sprayer assembly, which is connected to an outlet side of carding-applicator machine. Sprayer assembly preferably includes five sprayers connected to a supply line, which in turn, is connected via suitable tubing to one or more containers including conditioning solution. A valve is connected to an inlet to the supply line to control the flow rate of the conditioning solution to the supply line. After being carded, wool fibers are transported under the sprayers of sprayer assembly via an outlet conveyor belt. The sprayers uniformly apply the conditioning solution to wool fibers as the fibers move underneath the sprayers.

After the conditioning solution is applied to the fibers, the coated wool fibers are transported to a first hopper associated with the first mixing machine by suitable tubing or piping having an in line blower which generates a vacuum in the tubing attached between blower and the outlet side of carding-applicator machine to suction wool fibers into the tubing and forcefully blows air through tubing attached between blower and the first hopper to transport the coated wool fibers to the first hopper.

In the present embodiment, the mixing solution includes twenty percent (20%) mineral oil (lubricant), twenty percent (20%) of anti-static agent and sixty percent (60%) water. Other mixing solutions are contemplated and can be use in lieu of this embodiment. Preferably, about 5 kg of the mixing solution is applied to 100 kg of the wool fibers. The ratio of the mixing solution applied to the wool fibers may be adjusted as needed.

The coated wool fibers in the first hopper are gravity fed to first mixing machine. More specifically, first mixing machine includes a rotating drum that receives coated wool fibers from first hopper and rotates at a designated rate to ensure that the wool fibers are evenly coated with the conditioning solution. The first mixing machine operates for a designated period of time based on prior mixing times for mixing coated wool fibers. After the mixing is finished in first mixing machine, the wool fibers are transported to a second mixing machine via tubing connected between a second hopper associated with the second mixing machine and an outlet of first mixing machine. A second blower is connected in line with the tubing to generate a vacuum in the tubing between second blower and the outlet of first mixing machine and forcefully blows air through the tubing connected between second hopper and the second blower to transport the coated wool fibers from first mixing machine to second hopper as described above.

The second hopper gravity feeds coated wool fibers into second mixing machine, and more specifically, into a rotating second drum of the second mixing machine to further mix the coated wool fibers. Second mixing machine operates for a designated period of time to further distribute the conditioning solution on wool fibers. In the present method, the first and second mixing machines are substantially the same mixing machines. It should be appreciated that one or a plurality of mixing machines may be connected in series to mix the coated wool fibers. It should also be appreciated that the mixing machines may be the same or different mixing machines.

After the mixing process is finished, the wool fibers are transported to one of a plurality of storage areas or storage rooms via tubes connected to an inline blower. More specifically, a first end of each tube is connected to and extends partially through a top wall of a different one of the storage rooms and an opposing second end of each tube is connected to blower. The blower generates a vacuum at the outlet of the second mixing machine to suction the wool fibers from the outlet of the second mixing machine and toward an inlet of the blower. The wool fibers pass through blower and into one or more of the tubes connected to an outlet of the blower. One or more of the outlet tubes may be closed by adjustable baffles positioned inside of and movably connected to each of the tubes so that one or more of the tubes may be closed during operation to control the movement of wool fibers through the tubes and into one or more of the storage areas/storage rooms. As shown in storage, the wool fibers remain in one or more of the storage areas 136 for at least twenty-four hours to allow the conditioning solution to dry and set on the wool fibers. It should be appreciated that the storage time may be adjusted to longer or shorter periods depending on the batch size and amount of the mixing solution applied to the fibers. For example, smaller batch sizes require less storage time for the solution to dry and set.

Next, wool fibers are carded and slivered for further processing. As stated above, carding is a process that untangles and aligns the wool fibers to be generally parallel to each other in a flat sheet called a web. The web is then formed into narrow ropes known as slivers as further described below. The carding also removes any residual dirt and other foreign material and matter remaining on the wool fibers.

The carding and slivering process described above may be performed by one or more machines that untangle and align fibers and form the fibers into slivers. In the present embodiment, a combined carding and slivering machine (hereinafter referred to as a "CS machine") is used to perform the above steps. It should be appreciated that one or a plurality of the CS machines may be utilized in the present method. After the wool fibers 104 are stored in one or more of the storage rooms for at least twenty-four hours (or a lesser time for smaller amounts of the wool fibers), wool fibers are manually fed into one or more of the CS machines. In a carding portion of each of the CS machines, an inlet of each CS machine includes an inlet conveyor belt that moves or transports wool fibers toward a pivoting carding arm having a series of metal teeth similar to the carding arm discussed above. Each of the carding arms reciprocate between a non-engaged position and an engaged, carding position in which the carding arm, and more specifically, the teeth on the carding arm contact the wool fibers and untangle, clean, intermix and align the wool fibers.

After passing the pivoting carding arm in each of the CS machines, the carded wool fibers fall off of the end of the inlet conveyor and into an internal hopper, which gravity feeds the wool fibers toward an elongated, horizontal opening at the bottom of the internal hopper. A hopper conveyor belt positioned at the bottom of the internal hopper extends between the bottom of the internal hopper, through the hopper opening and to a first carding roller of a series of carding rollers. A packing roller is movably connected to each of the CS machines adjacent to the internal hopper opening and rotates counterclockwise to pack the wool fibers together and form a continuous wool fiber web. The web moves through the series of carding rollers. Each of the carding rollers is covered by a carding material including a plurality of teeth that comb or rake the fibers in the web to further untangle (i.e., break up clumps and knots in the wool fibers) and align the fibers as well as remove any remaining debris that may reside in the fiber web. The carding material is preferably made from a sturdy flexible scrim in which the teeth are closely spaced and embedded in the scrim. It should be appreciated that each CS machine may include one or more carding rollers and the carding rollers may have the same or a different number of teeth. Preferably, the teeth on each of the carding rollers are made of metal but may be made out of other suitable materials or combination of materials.

The continuous wool fiber web exits from the series of carding rollers and enters a slivering portion of the CS machine. In slivering portion, the wool fiber web moves between two converging walls that direct the web into a slivering mechanism. Each of the slivering mechanisms form the web into continuous strands or "slivers" of the wool fibers for subsequent knitting of the wool fibers as described below. Hereinafter, the terms "sliver" or "wool sliver" refers to a tubular material formed predominately from the wool fibers but may also include other natural or artificial fibers. In this embodiment, the slivers have a weight of 17 g/m. It should be appreciated that the weight of the slivers is preferably in the range of about 16.5 to 17.5 g/m, but other suitable weights are contemplated.

After exiting the slivering mechanism, the wool fiber slivers are directed into a container or canister during packing. Each of the containers is lined with a packing bag made of nylon or other suitable material. The containers are placed in one of a plurality of container positions or slots in a packing area in the slivering portion and separated by arms where the arms are rotatably connected to the CS machine. When a container, and more specifically, the bag inside the container is completely filled with a continuous wool fiber sliver, the sliver is manually cut and the arms are rotated either manually or automatically, to move the filled container away from the slivering mechanism and simultaneously move an empty container into position to be filled by the next continuous wool fiber web. The arms also help to hold the containers in position relative to the slivering mechanism during operation.

As stated above, when a container is filled with a wool fiber sliver, the container is moved away from the slivering mechanism and removed from the CS machine. Next, the packing bag is removed from the container and sealed by a drawstring attached to a top end of the packing bag or other suitable sealing device. Each of the filled packing bags is weighed and the weight and other pertinent information, such as the type and density of the wool blend of the sliver, is attached to or associated with the bag and recorded in a storage medium of a suitable processor such as a computer. Each packing bag is then transferred to a storage area for subsequent processing. The empty containers are each re-wrapped or re-lined with a new or empty packing bag and moved back to a container position in the packing area of one or more of the CS machines.

The wool fiber slivers are now secured to a base material, such as a textile scrim, in a fabric forming process, such as knitting. It should be appreciated that the term "scrim" used hereinafter refers to an underlying backing, framework or structure, including but not limited to, textiles. Furthermore, the terms "fabric" and "textile" as used herein refer to any type of cloth produced by knitting, weaving or non-woven textile processes. Although various fabric forming processes can be used consistent with this disclosure, knitting is a preferred process as described below.

After the slivering process, the wool fiber slivers are transferred to a combing process. In the combing process, a combing machine having one or more circular combs or rectilinear combs, combs the wool fiber slivers. The circular combs have long metal teeth with one comb holding the wool fiber, which is slowly dubbed in by a brush, while the other comb is moved through, slowly transferring the wool fiber to the moving comb.

Alternatively, a rectilinear comb uses a circular comb mounted on a drum to comb out the fringe and remove short fibers not held by a clamping mechanism. A row of pins, known as a top comb, is a very fine tooth comb, for example 25 teeth per inch, and is inserted in cylindrical combed fringe to act as an impediment to contaminates (burrs, seeds, etc.) in the wool fiber slivers. On a next circular combing, short finer fibers and contaminates are removed. The circular combing without short fibers are placed on a moving belt in an overlapping motion. The circular combing and top comb insertion is repeated and combed fibers, called tuft, are overlapped. The overlapping produces some cohesion allowing the tuft then to be twisted to form a combed sliver.

Combing the fibers removes the short fibers and arranges the remaining fibers in a flat bundle, with all the fibers going the same direction, i.e., arrange parallel to each other, in the combed wool fiber slivers. It should be appreciated that the wool fiber slivers may be moved through one or more combing machines, one or several times depending on the desired characteristics of the wool fibers. After combing, the combed wool fiber slivers are transferred to the yarning fabrication process in which one or more spools of yarn are generated having twisted wool fibers.

In the yarn fabrication process, each combed wool fiber sliver is fed through a yarning machine, where the strands of the wool fibers in the wool fiber slivers are further elongated and given additional twist.

The yarn is formed from the wool pile slivers by ring spinning and/or open-end spinning. In ring spinning, the twisted wool fiber slivers are fed from a spool through rollers. These rollers elongate the slivers, which passes through the eyelet, moving down and through a traveler. The traveler moves freely around the stationary ring at 4,000 to 12,000 revolutions per minute. The spindle turns the bobbin at a constant speed. This turning of the bobbin and the movement of the traveler twists and winds the yarn in one operation.

In open-end spinning, one or more slivers of the wool fibers are fed into a spinner by a stream of air. Each sliver is delivered to a rotary beater that separates the fibers into a thin stream that is carried into the rotor by a current of air through a tube or duct and deposited in a v-shaped groove along the sides of the rotor. As the rotor turns, the sliver is twisted.

In an example embodiment, the wool fiber slivers are passed through the yarn fabrication machine four times in a first yarning, a second yarning, a third yarning and a fourth yarning, to achieve the desired characteristics for the final wool pile fabric product. It should be appreciated that the wool fiber slivers may be made into yarn in a single yarning or in several yarning steps.

At this point, the wool fiber yarn may be dyed as described above. To dye the yarn, the wool fiber yarn is loosened (fibers spread apart) and dyed based on the dyeing process described above or another suitable dyeing process.

The wool fiber yarn, whether dyed or not, goes through a twisting process in which two yarns are twisted together to form a double twisted yarn ("DTY") or finished yarn. The double twisted yard is then transferred to the yarn knitting process.

In the yarn knitting process, the DTY yarn is used in a circular knitting process in which the DTY yarn is knit simultaneously with a backing material made of natural fibers, synthetic fibers or a combination on natural and synthetic fibers. In this process, the knitting is cast on and the circle of stitches is joined to form a circular, seamless knit material. Depending on the fibers used to make the backing material, the backing material can be made to have different physical properties including directional stretch.

The present method utilizes a plurality of knitting machines where each of the knitting machines has a plurality knitting feed devices for feeding the DTY yarn into the machines. It should be appreciated that the present method may employ one or a plurality of knitting machines each having a suitable number of feed devices. Each feed device of the knitting machines is preferably configured to receive one of DTY yarn spool. It should be appreciated that the number of DTY yarn spools loaded on the machine depends on the size of the wool pile fabric.

During the knitting process, the strands forming the scrim and the DTY yarn are simultaneously knit together in the knitting step to produce a tubular or circular knit pile fabric, hereinafter referred to as a "semi-finished pile fabric." It should be appreciated that scrim or backing material may be made with any suitable material or combination of materials and is typically made with a fabric material. It should also be appreciated that other suitable yarning process, knitting process, weaving process or attachment process may be used to attach the DTY yarn to the scrim.

In a cutting step, a knife or cutting blade is fixedly positioned beneath the knitting feed devices parallel to and in contact with the semi-finished tubular pile fabric such that the cutting blade longitudinally cuts the semi-finished pile fabric as the fabric is being knit by the knitting feed devices. The knitting process continues until the semi-finished pile fabric 218 reaches a designated length, which in the present embodiment, is a length of about 13 to 14 meters. When the knitting process is finished, the operator manually cuts the semi-finished pile fabric 218 transverse to the longitudinal axis of the product to separate the fabric from the knitting machine. The semi-finished pile fabric is then removed for subsequent processing. Alternatively, the knitting machine is positioned on an elevated structure or floor such that the semi-finished pile fabric may be retrieved by an operator from below the knitting machine. In the present method, the above steps are performed multiple times by one or more knitting machines to produce a plurality of semi-finished pile fabrics pieces.

After the yarn knitting and cutting steps, the semi-finished pile fabric is inspected in an inspection process to verify the dimensions of the semi-finished pile fabric and to check for any irregularities, defects and deformities. Specifically, in an initial inspection step, a first one of the semi-finished pile fabrics or "greiges" is loaded into an inspection machine to check the dimensions of the semi-finished pile fabric. Preferably, the present method utilizes two inspection machines to inspect the semi-finished pile fabric. It should be appreciated that any suitable number of the inspection machines may be used to inspect the semi-finished pile fabric.

In the present method, an end of the initial piece or sheet of the semi-finished pile fabric is inserted or fed into the inspection machine so the wool fibers on the semi-finished pile fabric are angled toward the machine. After the knitting process, a majority of the wool fibers extend or are angled in the same direction when the knitting process is finished. The operator feeds the end of the semi-finished pile fabric into the inspection machine so that the wool fibers are angled toward the inspection machine. This end is inserted first into the inspection machine and is marked with a suitable identifier such as a letter, number or other symbol, to indicate that it is the initial of first end of the semi-finished pile fabric sheet.

In a marking step, the scrim near the first end or feed end is marked with the letter "A" and the scrim located near the opposing end or non-feed end is marked with the letter "B." It should be appreciated that other suitable symbols may be used to mark the ends of the semi-finished pile fabric. The positioning of the semi-finished pile fabric and the marking of the ends of the fabric are relevant in subsequent processing steps as described below.

The inspection machine includes a series of rollers in communication with a digital display. A sheet or length of the semi-finished pile fabric is attached to and fed through the rollers of the inspection machine which measures the width and length of the product. Alternatively, the dimensions of the semi-finished pile fabric are manually measured. If the semi-finished pile fabric is not within pre-determined tolerances for the length and width, the product is rejected. Additionally, while the semi-finished pile fabric is being fed through the inspection machine, an operator checks the scrim for missed stitches, holes or other defects. If a defect is detected, the operator stops the inspection machine and manually repairs the defect using a needle and thread or other suitable repairing tools in a repairing step. The defects may also be automatically repaired by one or more repairing machines. The operator may also check other parameters of the semi-finished pile fabric including, but not limited to, the density and softness of the product. If no defects are found by the operator and the semi-finished pile fabric has the designated length and width, the fabric is transferred to a storage area, such as a warehouse or storage room, for further processing.

In a pre-finishing process 400, two or more pieces or sheets of the semi-finished pile fabric are attached, i.e., stitched, together end-to-end in an attachment step by an overlock stitching machine to combine the semi-finished pile fabric sheets based on a designated overall length of the wool pile fabric needed for a particular application. As stated above, the wool fibers of each of the pieces of the semi-finished pile fabric are generally angled in a single direction. Thus, the pieces of the semi-finished pile fabric are attached together so the wool fibers of each of the pieces all extend or are angled in the same direction, i.e., the ends marked with an "A" of one semi-finished pile fabric piece is attached to the ends marked with a "B" of the preceding fabric piece. The directional alignment of the wool fibers on the connected semi-finished pile fabric sheets is relevant in the shearing processes described below.

The combined semi-finished pile fabric 101 has a relatively smooth back side 108 (backing material 104) and an opposing fleece or wool fiber side 106 having wool fibers 102 that replicate natural sheepskin. At this stage the wool is rough and bristly. To prepare the semi-finished pile fabric for end product manufacturing, such as footwear, the fabric goes through the finishing process 500.

In the finishing process 500, the semi-finished pile fabric is heated and stretched to a designated final width by one or more machines. In this embodiment, the semi-finished pile fabric is passed through a heat setting machine for stretching the semi-finished pile fabric to the designated or desired width. The heat setting machine includes a series of rollers and a frame portion to guide and move the semi-finished pile fabric adjacent to a coating applicator that applies a back side coating or stiffening solution including a stiffening agent to the scrim and then conveys the fabric through multiple ovens for curing or setting the coating. In one embodiment, the heat setting machine includes series of eight ovens. It should be appreciated that another suitable number of ovens may be used to dry and set the conditioning solution on the scrim.

Initially in a pre-heating step, the heat setting machine is activated and a plurality of the ovens are pre-heated to a predetermined preferred temperature of 140° C. and one or more ovens following the ovens are pre-heated to a predetermined preferred temperature of 114° C. It should be appreciated that the temperature of ovens can be in the range of about 134° to 143° C. and that the temperature of each oven or ovens can be in the range of about 110° to 118° C. It should also be appreciated that other suitable temperatures can be used depending on operating and ambient conditions provided that the temperature is not so hot so as to damage the semi-finished pile fabric. In this embodiment, the ovens are heated by steam.

When the ovens reach the respective predetermined temperatures, a guide cloth is temporally attached to the semi-finished pile fabric by an overlock stitching machine or other suitable stitching machine as described above and then fed into the heat setting machine. The guide cloth enables the operator to adjust the roller tension and the oven temperatures of the heat setting machine before the semi-finished pile fabric is fed through the machine to prevent unnecessary damage to and waste of the semi-finished pile fabric. In a coating step, at least one applicator roll applies a stiffening solution or agent to the scrim of the semi-finished wool product, as the semi-finished pile fabric is fed into the heat setting machine. A trough holds a bath of stiffening solution. Applicator roll is positioned at least partially in the trough. Roll rotates within trough and stiffening solution adheres to the outer surface of the roll. Roll contacts the scrim of the semi-finished pile fabric to apply the stiffening solution to the scrim. The stiffening solution fixes the knit structure of the scrim, helps bond the wool fibers within the scrim, and reduces the stretchability of the scrim and thereby the stretchability of the semi-finished pile fabric. In an embodiment, the stiffening solution includes an impermeable stiffener (30%), a permeable stiffener (50%) and a polyacrylic emulsion (20%). It should be appreciated that the relative quantities of component ingredients may be adjusted depending on operating conditions. Also other agents may be added to the solution, and alternative stiffing solutions as known in the art as later developed can be used.

After the stiffening solution is applied, the semi-finished pile fabric is stretched, preferably using at least one and more preferably two metal rollers, each having a helical protrusion and groove. Steam is applied to the semi-finished pile fabric while stretching the product lengthwise, which narrows the width of the product from an initial width of about 1.9 m to a width in the range of 1.3 to 1.4 m. In this embodiment, the semi-finished pile fabric is fed through the heated rollers (heated to a temperature of about 130° C.) at a speed of about 8 m/min. The speed and temperature of the heated rollers may be adjusted as necessary to achieve a desired product width. An opposing series of rotating pins at least partially penetrate the edges of the fabric, simultaneously stretching the width of the fabric while guiding the fabric through the ovens to achieve a final width of 1.50 to 1.55 m.

After exiting the heat setting machine, the width of the wool pile fabric is measured as a final check in step. If the width is not within acceptable tolerance limits, the finished product is re-fed into the heat setting machine a second time and the above steps are repeated to further stretch the finished product to the desired final width. It should be appreciated that the semi-finished pile fabric may be coated with the stiffening solution and passed through the heat setting machine one or a plurality of times to achieve a finished product having the designated final width. When the finished product is at the designated final width, the guide cloth is removed and the finished product is either stored for future processing or transported to the post-finishing process.

At this stage, the wool fiber side of pile fabric is coarse and bristly, and generally unsuitable for use in many products including footwear and apparel where the wool fibers will come into contact with a wearer's skin. In the present method, the wool pile fabric is finished in an unconventional manner that is conceptually more similar to natural sheepskin finishing processes as contrasted with conventional textile finishing processes. Heretofore, natural sheepskin finishing processes have not been used on pile fabrics or other textiles. However, unlike natural sheepskin finishing processes, where individual skins are finished one at a time, automated, continuous web processing machinery and equipment have been developed to finish the length of pile fabric in a high speed, efficient manner. After the finishing process the wool pile fabric is soft to the touch and closely resembles natural shearling fleece in feel and appearance.

In the post-finishing process, the wool pile fabric is fed through a sequence of post-finishing machines. Initially, the wool pile fabric is fed through one or more brushing machines shown in FIG. 10. The brushing machines brush the coarse wool fibers of the wool pile fabric to straighten and brush out the wool fibers to replicate natural fleece.

After exiting the brushing process, the wool pile fabric goes through one, or a plurality of polishing steps to soften, comb and enhance the luster of the wool fibers. The polishing steps are performed by one or more machines. In the present embodiment, the wool pile fabric is fed through a plurality of double polishing roll stations. Each polishing station may include one or more polishing rolls. Alternatively, the length of fabric can be fed though a single polishing roll station two or more times. The polishing roll station includes a series of stationary guides, a pivoting guide for aligning the fabric, guide rollers and a frame portion that guide and convey the wool pile fabric and more specifically, the wool fiber side of the finished fabric against two independent, heated polishing rolls. In this embodiment, each roll operates at about 840 rpm. At a polishing station, having two rolls, a first roll rotates in a direction opposite to the direction of travel of the length of fabric, while a second roll rotates in the same direction of travel as the fabric. The rolls rake the wool pile side of the fabric to remove crimps from the ends of the wool fibers and frictionally engage and thereby initially polish and comb the wool fibers. The different direction of rotation of the rolls helps avoid a directional lay of the wool fibers. In the present embodiment, the feed rate of the wool pile fabric through each of the first two double polishing roller machines is about 6.0-8.0 m/min and the temperature of the first polishing roll is about 250° C. and the second polishing roll is slightly cooler at about 240° C. Because the first roll heats the wool pile, the temperature of the wool pile fabric entering the second roll is somewhat warmer than entering the first roll. It should be appreciated that the polishing rolls may be set at a temperature sufficient to polish the wool fibers of the pile fabric but not so hot as to damage the fibers.

In order to effectively polish the wool fibers of the pile fabric, each of the polishing rolls 800 (FIG. 11) includes a plurality of pairs of segmented blades where the blades in each pair are positioned on opposing sides of the roll. The segmented blades 802 each include a multiplicity of diamond-shaped protrusions or teeth 804 (see the enlarged inset of the protrusions) that extend at least 5 mm outwardly from the outer roll surface 805. It should be appreciated that the protrusions may have other suitable shapes and may extend at any suitable distance from the roll surface. The protrusions of the blades contact, and more specifically, at least partially comb or rake the wool fibers and in combination with the heated outer surface of the roll, polish the wool fibers. To help control the temperature of the wool fibers contacting the roll surface, a recessed chute or groove 806 is provided on the roll in between each of the pairs of blades to reduce the surface area of the roll that is in contact with the wool fibers. Otherwise, the heated roll surface could overheat and damage the wool fibers. Additionally, a leading edge or lip of the grooves contacts the wool fibers to further polish the fibers.

In an optional finish coating step, a conditioning, polishing or finish coating is applied to the wool fibers to enhance the luster and softness of the wool fibers as well as improve the anti-static properties of the fibers. The coating may be a sheepskin conditioning solution as known in the art for softening, conditioning and improving the luster of natural shearling fleece. In an embodiment, a finish coating includes a polishing agent (22%), a softening agent (15%), alcohol (17%), a hot stamping agent (10%) and water (36%). The polishing agent enhances the glossiness and luster of the wool fibers. The alcohol and the softening agent enhance the softness and feel of the fibers and the hot stamping agent includes a silicone oil that increases the smoothness and straightens the fibers. It should be appreciated that the relative proportions of the above agents may be adjusted to suit particular operating conditions, that other suitable agents could be added, and that other conditioning coatings as known in the art or later developed could be used in place thereof.

The coating is preferably applied at a coating station including a series of guide rollers and a coating applicator roll having an outer brush surface. The applicator roll is positioned adjacent to a supply or metering roll which transfers the finish coating from trough to the applicator roll. It should be appreciated that the coating station may include one or more supply rolls and coating applicator rolls to apply a desired volume or coating weight to the wool fibers of the wool pile fabric.

After the finish coating is applied to the wool pile side of fabric, the wetted fabric is optionally guided or fed through one or more polishing roll stations to force the coating toward the base of the wool fibers, to further remove any remaining crimping on the wool fiber ends and to polish the fiber ends.

Another additional optional post-finishing process includes tumbling that curls the wool fibers of the wool pile fabric. A tumbling machine includes a housing and a door slidably or pivotably attached to the housing that provides access to a heated drum-type roller (similar to a clothes dryer) configured to receive the wool pile fabric. The wool pile fabric is inserted into the drum roller and the drum roller is heated to a predetermined temperature and rotated for a designated period time. When the tumbling process is finished, the wool fibers of the wool pile fabric are uniformly curled.

After the post-finishing process is finished, the wool pile fabric is transported to a storage area or to a shipping area for shipping to another location such as a distributor or end product manufacturer such as a footwear manufacturer.

Figure 14:
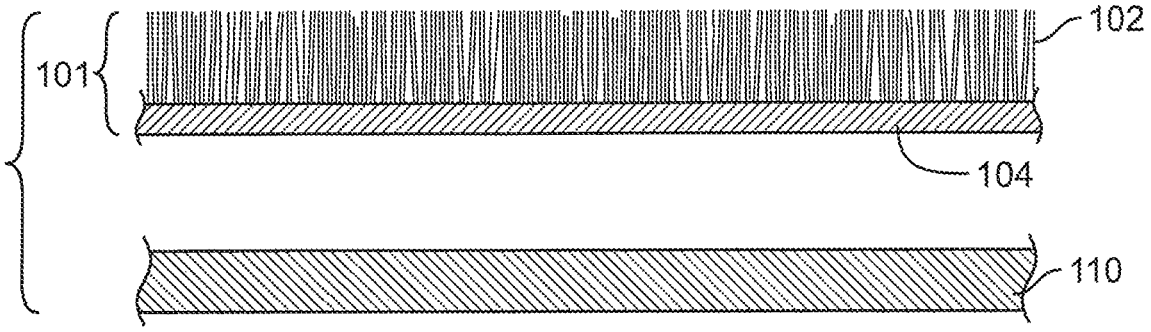
FIG. 14 is an exploded, cross-section view of a finished wool pile fabric product including a facing layer.

Typically, the scrim of the wool pile fabric does not have a desirable appearance to be used as the outer surface of an end product such as footwear. Accordingly, the wool pile fabric 101 is optionally attached to a suitable facing material 110 in a lamination step as shown in FIG. 14. In the lamination process, a facing material is glued, sewn or otherwise attached to the scrim to enhance the finished product. An example wool pile fabric laminated to a facing. It should be appreciated that the terms "facing" and "facing material" are used herein to refer to an outer layer of natural or artificial material. It should be appreciated that the facing material may be any suitable material, including but not limited to, ethylene vinyl acetate (EVA), vinyl, leather, suede, fabric, textile, synthetic leather, synthetic suede or other suitable natural or synthetic material or combination of these materials.

Figure 15:
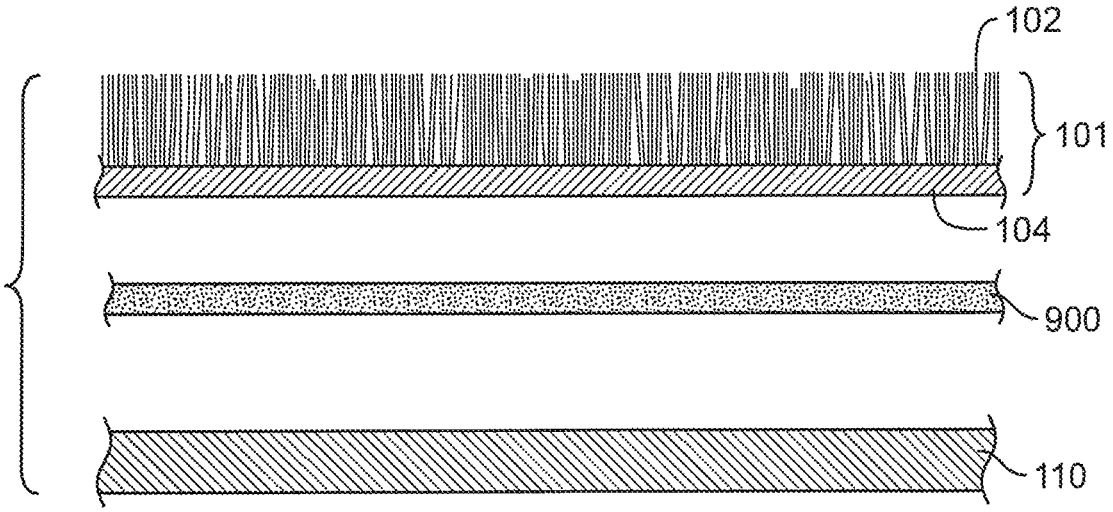
FIG. 15 is an exploded, cross-section view of a finished wool pile fabric product including a facing layer and an intermediate layer.

In FIG. 15, an enlarged, exploded view of another embodiment is illustrated where the wool pile fabric 101 includes wool fibers 102 and one or more intermediate layers 900 positioned and attached between the scrim 104 and the facing material 110. In one example, the intermediate layer is a waterproof material layer to inhibit water and moisture from moving into the fleece side. In another example, the intermediate layer is an insulating material layer. It should be appreciated that the intermediate layer or layers may be made with any suitable material or combination of materials.

Figure 1:
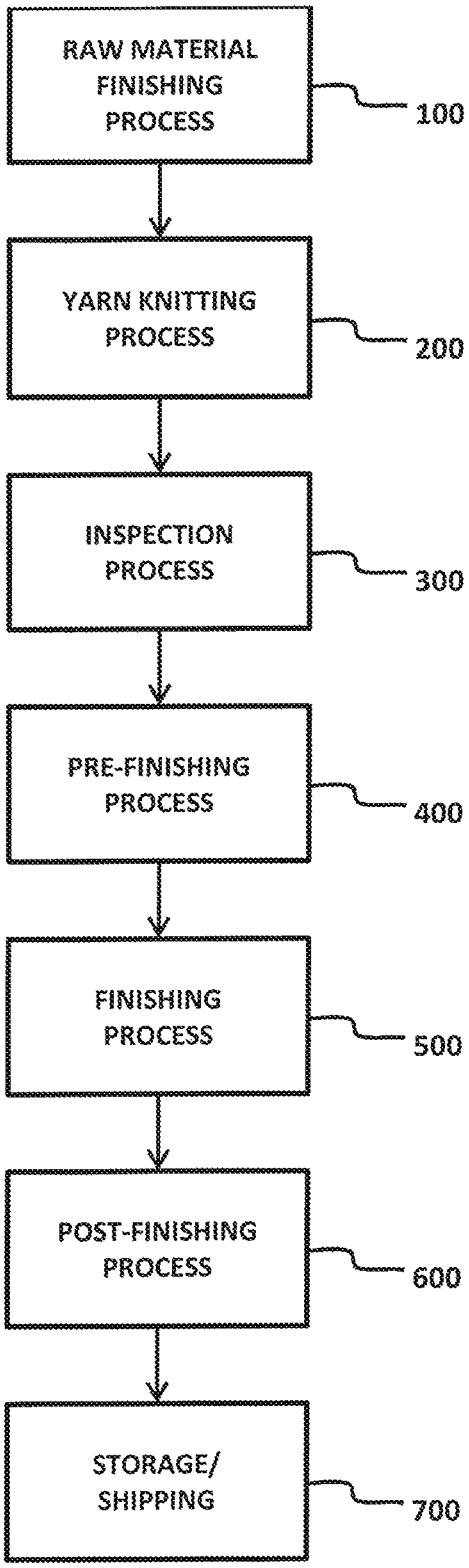
FIG. 1 is a schematic diagram showing the different processes for making and shipping the present wool pile fabric product according to the present invention.
Figure 16:
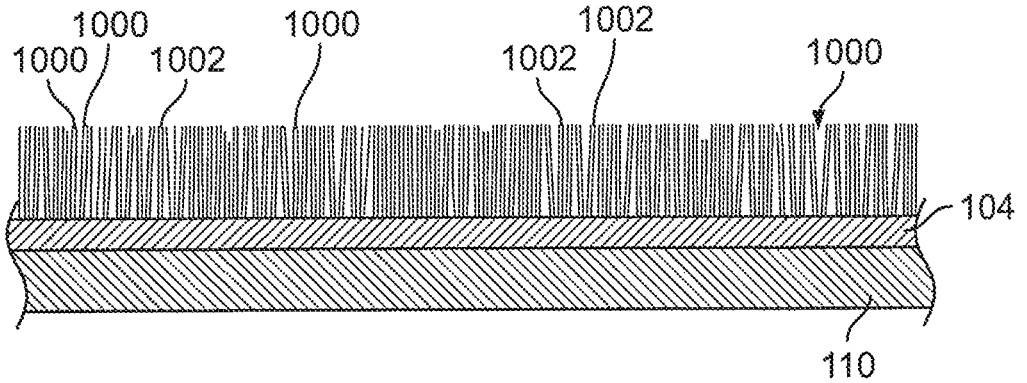
FIG. 16 is a cross-section view of the finished wool pile fabric product of FIG. 12.

In a further embodiment shown in FIG. 16, wool fibers 1000 can be blended with non-wool fibers 1002 by mixing the fibers in the raw material finishing process step 100 (see FIG. 1). The non-wool fibers may include natural or artificial fibers such as phase change fibers, sensitive fibers and odor reducing fibers. Phase change fibers are used to manage the temperature of the pile fabric made from the combination or blend of phase change and wool fibers. For example, the phase change fibers cause the fleece to feel cooler than fleece to adjust to varying temperatures in different parts of the world and at different seasons (winter, spring, summer and fall). Sensitive fibers make the fleece feel softer where the softness of the fleece can be adjusted by adjusting the amount of the sensitive fibers mixed with the wool fibers. Odor reducing fibers include zinc oxide that inhibits bacteria growth on the fleece that may be present from sweat and other elements. Preventing or limiting the amount of bacteria on the fleece, eliminates or reduces the odor of the fleece. It should be appreciated that other suitable fibers may be mixed with the wool fibers and that any suitable amount or mixture of the above processed fibers with the wool fibers may be used in embodiments of the sheared wool processing method described above.

Figure 17:
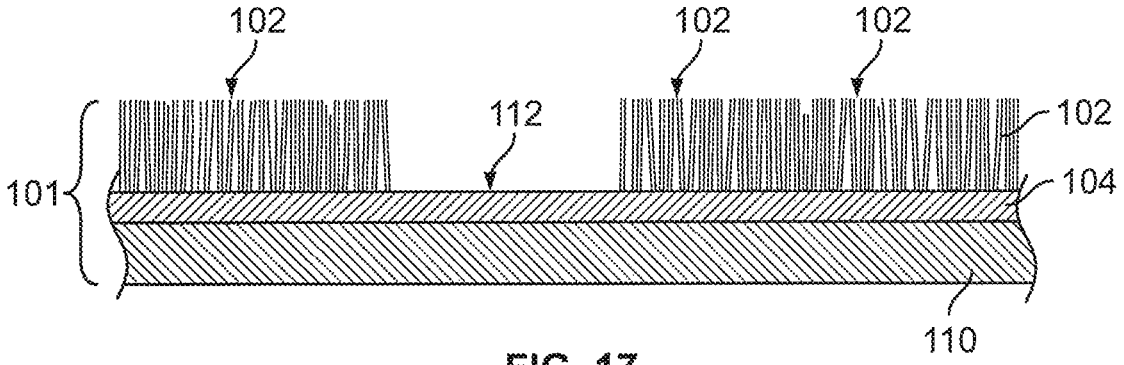
FIG. 17 is a cross-section view of an embodiment of the finished wool pile fabric product including a portion of the fleece side without fibers.

In FIG. 17, in another embodiment, the wool pile fabric 101, and more specifically, the pile side of the wool pile fabric is made with wool fibers 102 having different lengths or sections of the wool fibers having different lengths. For example, the pile side includes alternating sections including sections with wool fibers having a length of 0.7 mm and sections with fibers having a length of 0.1 mm. In another example, the pile side has wool pile sections separated by bare sections 112 with little or no fibers. It should be appreciated that the pile side of the semi-finished wool product may include sections having any suitable wool fiber length or sections having no wool fibers. It should also be appreciated that the above fleece sections may be sections having the same wool fibers, a mixture of wool fibers and the non-wool fibers discussed above or solely the processed fibers. The varying lengths of the sections and the sections having no fibers allow for air flow through the fleece, such as in a liner of a boot or a shoe, to enhance user comfort and temperature control.

Figure 18:
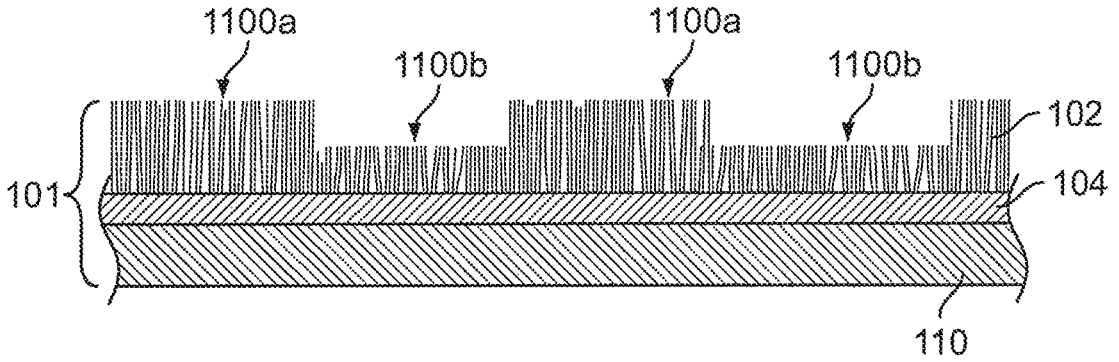
FIG. 18 is a cross-section view of another embodiment of the finished wool pile fabric product having different fiber lengths.

In FIG. 18, in another embodiment, the fleece side of the semi-finished wool product or the wool pile fabric 101 includes one or more sections having wool fibers of different densities 1100*a* and 1100*b* (i.e., the number of wool fibers per square inch), which helps control the air flow through the fleece on the fleece side. In one example, the length and/or density of the fibers of the wool pile fabric is different in the forefoot region, ball region or heel of footwear for controlling the comfort level and support in different regions or sections of footwear. It should be appreciated that the number of fibers in a particular area or areas on the scrim, i.e., the density, may be uniform or may vary along a length, a width or in any suitable pattern on the scrim.

After the wool pile fabric has been manufactured, it can be prepared for shipment to warehouses, product manufacturers, such as apparel and footwear manufacturers, distribution facilities or other facilities for end processing and distribution in the storage/shipping process 700 (FIG. 1).

Figure 19:
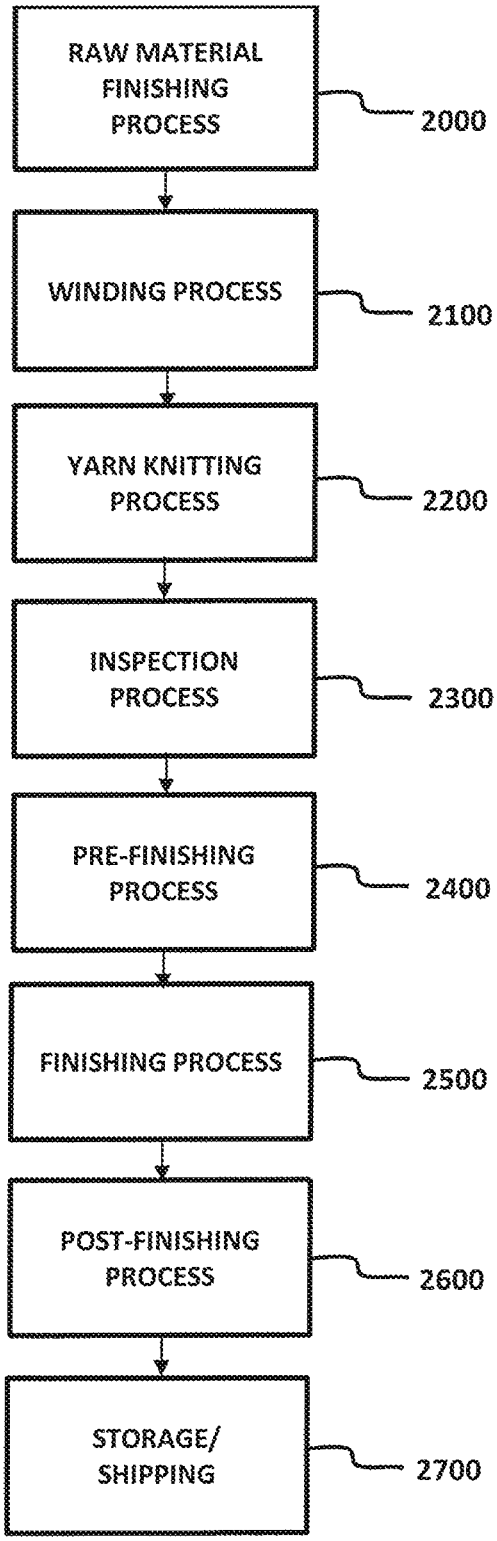
FIG. 19 is a schematic diagram showing the different processes for making and shipping the present wool pile fabric product according to another embodiment of the present invention.
Figure 20:
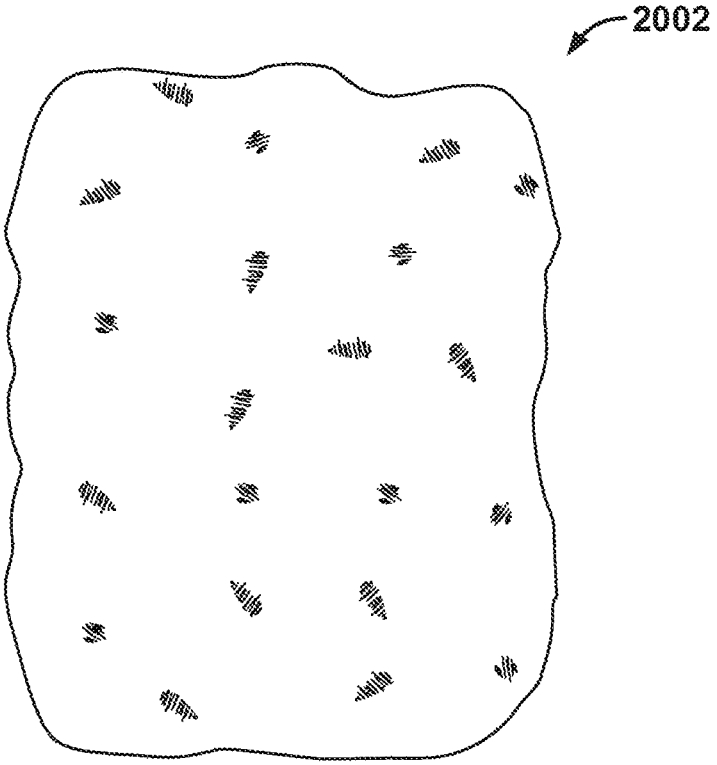
FIG. 20 is a perspective view of a fleece side of a wool pile fabric product manufactured by the processes shown in FIG. 19.
Figure 21:
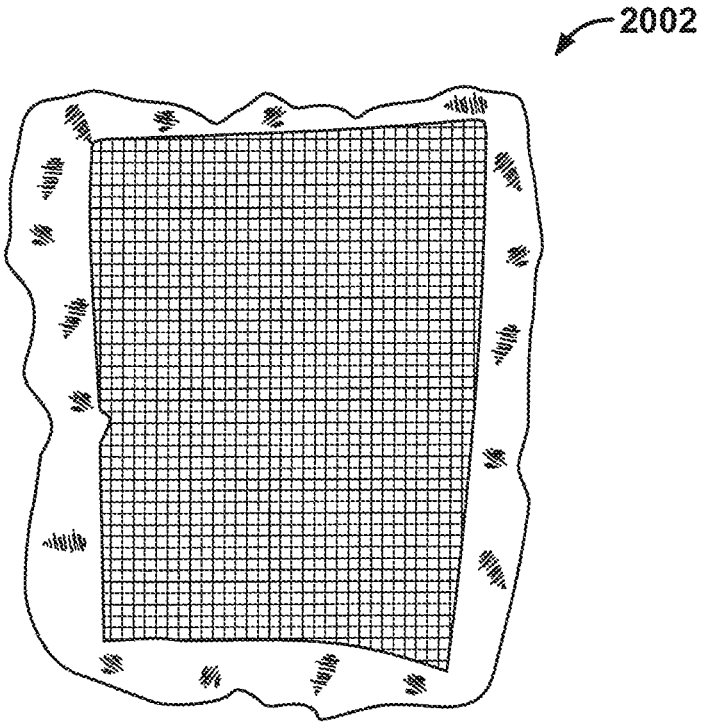
FIG. 21 is a perspective view of a scrim side of a wool pile fabric product manufactured by the processes shown in FIG. 19.
Figure 22:
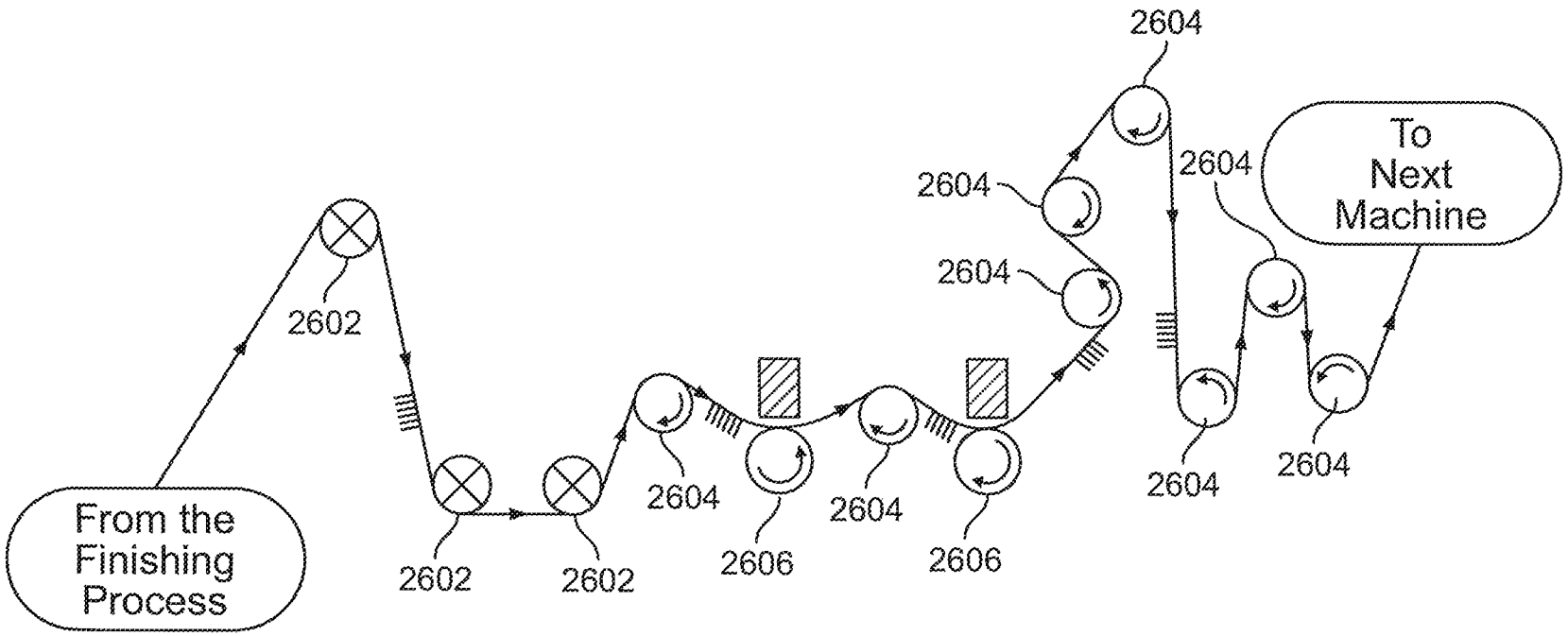
FIG. 22 is a schematic diagram showing an embodiment of a brushing machine used in the brushing process for brushing and straightening the fibers of the wool pile fabric product.

Referring to FIGS. 19-27, an embodiment of the present method for making a sheared wool product includes the following processes: a raw material finishing process 2000, a winding process 2100, a yarn knitting process 2200, an inspection process 2300, a pre-finishing process 2400, a finishing process 2500, a post-finishing process 2600 and a storage/shipping process 2700. Examples of the finished sheared wool product 2002 (hereinafter referred to as the "final product") are shown in FIGS. 20-21.

As described above, the raw material finishing process 2000 begins with the shearing, processing and conditioning of natural wool sheared from live sheep, sheepskins and/or pelts in a shearing step to provide wool fibers as illustrated in FIG. 2. The wool fibers are the natural fibers from sheep that comprise wool used in manufacturing the wool pile fabric. Initially, the wool fibers are cleaned in a washing step to remove impurities such as oils from the sheep's skin, dirt and odor. Specifically, the wool fibers are placed in a cleaning machine that washes the wool fibers using water and suitable cleaning solutions. After being cleaned, the wool fibers are formed into a designated amount of yarn, called "hanks" of yarn (i.e., bunches of yarn), and the yarn is dyed to a desired color or combination of colors.

In the dyeing process, one or more dyeing machines are used to dye the wool fiber yarn, i.e., hanks of wool fiber yarn, to the desired color. Each dyeing machine includes a housing defining an internal chamber having an opening, and a cover hingedly connected to the housing for enabling access to the chamber and for sealing the chamber during operation. One or more rotating, hollow, horizontally oriented rods are attached to and extend from the housing inside the chamber and are configured to receive one or more of the hanks of the wool fiber yarn. The rods are each connected to a container having the desired dye. The dye is supplied to the rods under pressure using a pump or similar device and exits through holes formed in each of the rods. Each hank of yarn is draped over one of the rods. During the dyeing process, the rods rotate and in turn, rotate the hanks of wool fiber yarn while the dye is emitted from the holes in the rods and onto the hanks of wool fiber yarn. In this way, the dye is applied uniformly to the entire length of each of the hanks of wool fiber yarn. Excess dye collects in the bottom of the internal chamber and is pumped through an outlet to a storage tank or other area for re-cycling or disposal. Typically, the hanks of wool fiber yarn are dyed by the dyeing machine for 3-4 hours, where the time depends on the color of the dye being applied to the yarn.

After being removed from the dyeing machines, the hanks of wool fiber yarn are placed in one or more spinning machines. Each spinning machine has a rotating drum with holes in it. The hanks of wool fiber yarn are rotated or spun by the drum at 500-1800 revolutions per minute (rpm) for 10-15 minutes to remove an initial amount of moisture from the hanks of wool fiber yarn. During this process, an amount of water (moisture) from the hanks of wool fiber yarn exits through the holes in the drum as the drum rotates or spins. The removed water is recycled or discarded as described above.

Next, the hanks of wool fiber yarn are supplied to a drying machine. The drying machine has a conveyor extending through a housing where the housing includes one or more dryers having heaters, where the heaters are each set to a temperature of 75-100° C. The dryers generate heated air that is circulated within the housing to dry the hanks of yarn as the hanks of yarn travel through the housing. More specifically, the hanks of wool fiber yarn are placed on the conveyor after the spinning process where the conveyor transports the hanks of wool fiber yarn through the housing to be dryed. The dryed hanks of wool fiber yarn exit the housing and are then packaged and sent for winding, where the winding process winds the yarn onto one or more spools.

Alternatively, it should be appreciated that if the natural color of the wool fiber yarn is the desired color, the dyeing process is not needed. Therefore, instead of going through the dyeing process described above, the wool fiber yarn is packaged and sent directly to the winding process 2100.

Prior to the winding process 2100, the wool fiber yarn, whether dyed or not, goes through a twisting process in which two yarns are twisted together to form a double twisted yarn ("DTY") or finished yarn. The double twisted yarn is then transported to the winding process.

In the winding process 2100, the wool fiber yarn is attached to a winding machine that winds the yarn onto a cone-shaped spool. The cone-shaped spool is configured to fit on a circular knitting machine described in more detail below. After the winding machine(s) wind all of the wool fiber yarn onto one or more cone-shaped spools, the spools are transported to the yarn knitting process 2200.

Figure 3:
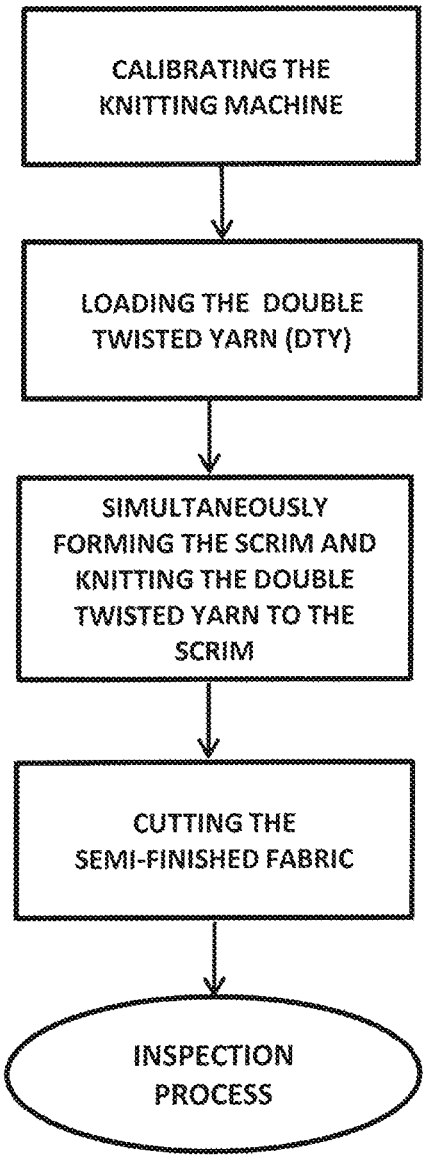
FIG. 3 is a schematic diagram showing the steps of the knitting process.

Referring to FIGS. 3 and 19, in the yarn knitting process, the DTY yarn (wool fiber yarn) is knit simultaneously with a backing material made of natural fibers, synthetic fibers or a combination on natural and synthetic fibers. In this process, the knitting is cast on and the circle of stitches is joined to form a circular, seamless knit material. Depending on the fibers used to make the backing material, the backing material can be made to have different physical properties including directional stretch.

The knitting machines have a plurality of knitting feed devices for feeding the DTY yarn into the machines. It should be appreciated that the present method may employ one or a plurality of knitting machines each having a suitable number of feed devices. Each feed device of the knitting machines is preferably configured to receive one of DTY yarn spools, i.e., the cone-shaped spools. It should be appreciated that the number of DTY yarn spools loaded on the machine depends on the size of the wool pile fabric.

During the knitting process 2200, the strands forming the scrim and the DTY yarn are simultaneously knit together in the knitting step to produce a tubular or circular knit pile fabric, hereinafter referred to as a "semi-finished pile fabric." It should be appreciated that scrim or backing material may be made with any suitable material or combination of materials and is typically made with a fabric material. It should also be appreciated that other suitable yarning process, knitting process, weaving process or attachment process may be used to attach the DTY yarn to the scrim.

In a cutting step, a knife or cutting blade is fixedly positioned beneath the knitting feed devices parallel to and in contact with the semi-finished tubular pile fabric such that the cutting blade longitudinally cuts the semi-finished pile fabric as the fabric is being knit by the knitting feed devices. The knitting process continues until the semi-finished pile fabric reaches a designated length, which in the present embodiment, is a length of about 22-25 meters that corresponds to a pre-determined designated weight of the fabric.

When the knitting process 2200 is finished, the operator manually cuts the semi-finished pile fabric transverse to the longitudinal axis of the product to the designated length and separate the fabric from the knitting machine. The semi-finished pile fabric is then removed for subsequent processing. Alternatively, the knitting machine is positioned on an elevated structure or floor such that the semi-finished pile fabric may be retrieved by an operator from below the knitting machine. In the present method, the above steps are performed multiple times by one or more knitting machines to produce a plurality of semi-finished pile fabrics pieces.

Figure 4:
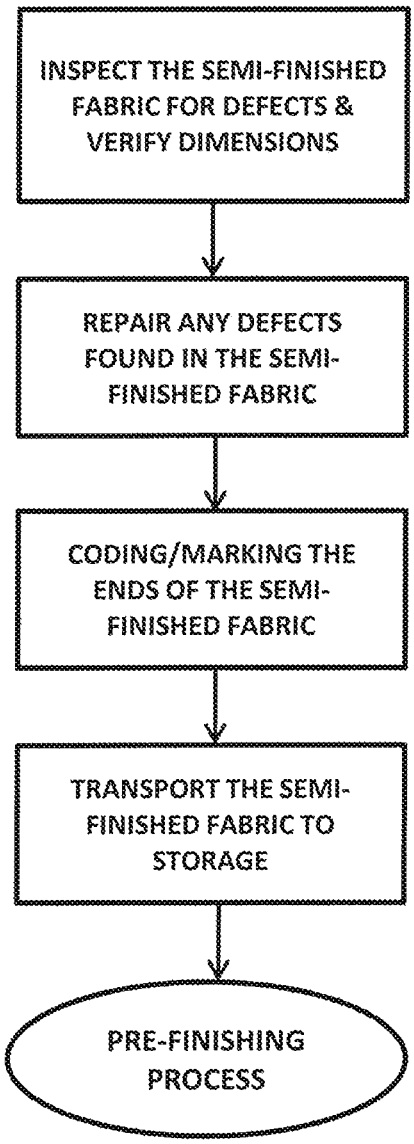
FIG. 4 is a schematic diagram showing the steps of the inspection process.

Referring to FIGS. 4 and 19, after the yarn knitting and cutting steps, the semi-finished pile fabric is inspected in an inspection process 2300 to verify the dimensions of the semi-finished pile fabric and to visually check for any irregularities, defects, holes, dirt and other deformities. Specifically, in an initial inspection step, a first one of the semi-finished pile fabrics or "greiges" is loaded into an inspection machine to check the dimensions of the semi-finished pile fabric. Preferably, the present method utilizes two inspection machines to inspect the semi-finished pile fabric. It should be appreciated that any suitable number of the inspection machines may be used to inspect the semi-finished pile fabric.

In the present method, an end of the initial piece or sheet of the semi-finished pile fabric is inserted or fed into the inspection machine so the wool fibers on the semi-finished pile fabric are angled toward the machine. After the knitting process, a majority of the wool fibers extend or are angled in the same direction when the knitting process is finished. The operator feeds the end of the semi-finished pile fabric into the inspection machine so that the wool fibers are angled toward the inspection machine. This end is inserted first into the inspection machine and is marked with a suitable identifier such as a letter, number or other symbol, to indicate that it is the initial of first end of the semi-finished pile fabric sheet. Also, the semi-finished pile fabric is marked in a marking step as described above.

The inspection machine includes a series of rollers in communication with a digital display. A sheet or length of the semi-finished pile fabric is attached to and fed through the rollers of the inspection machine which digitally measures the width and length of the product using a suitable digital measuring device and display the width and length on the digital display. Alternatively, the dimensions of the semi-finished pile fabric are manually measured. If the semi-finished pile fabric is not within pre-determined tolerances for the length and width, the product is rejected.

Additionally, as described above, while the semi-finished pile fabric is being fed through the inspection machine, an operator checks the scrim for missed stitches, holes or other defects. If a defect is detected, the operator stops the inspection machine and manually repairs the defect using a needle and thread or other suitable repairing tools in a repairing step. The defects may also be automatically repaired by one or more repairing machines. The operator may also check other parameters of the semi-finished pile fabric including, but not limited to, the density and softness of the product. If no defects are found by the operator and the semi-finished pile fabric has the designated length and width, the fabric is transferred to a storage area, such as a warehouse or storage room, for further processing, or transferred directly to the pre-finishing process 2400.

Figure 5:
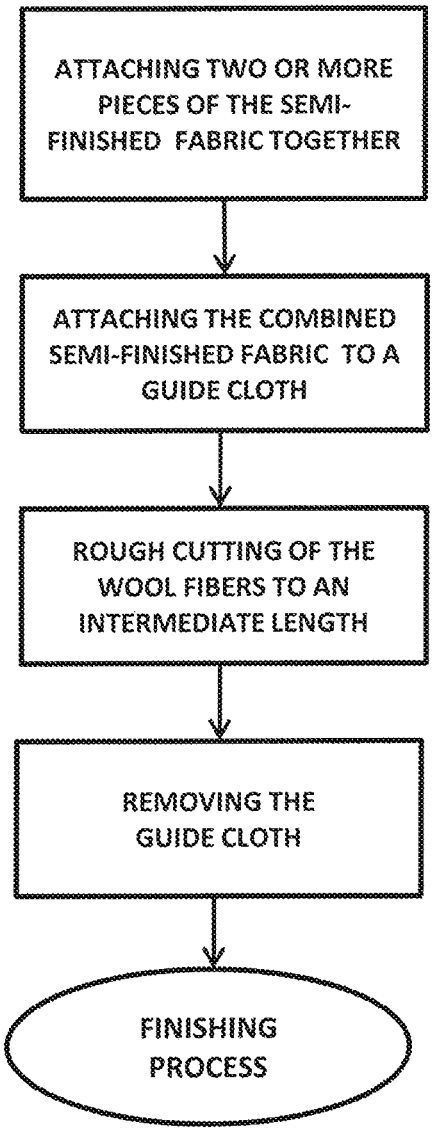
FIG. 5 is a schematic diagram showing the steps of the pre-finishing process.

Referring to FIGS. 5 and 19, in a pre-finishing process 2400, two or more pieces or sheets of the semi-finished pile fabric are attached, i.e., stitched, together end-to-end in an attachment step by an overlock stitching machine to combine the semi-finished pile fabric sheets based on a designated overall length of the wool pile fabric needed for a particular application. As stated above, the wool fibers of each of the pieces of the semi-finished pile fabric are generally angled in a single direction. Thus, the pieces of the semi-finished pile fabric are attached together so the wool fibers of each of the pieces all extend or are angled in the same direction, i.e., the ends marked with an "A" of one semi-finished pile fabric piece is attached to the ends marked with a "B" of the preceding fabric piece. The directional alignment of the wool fibers on the connected semi-finished pile fabric sheets is relevant in the shearing processes described below.

Figure 6:
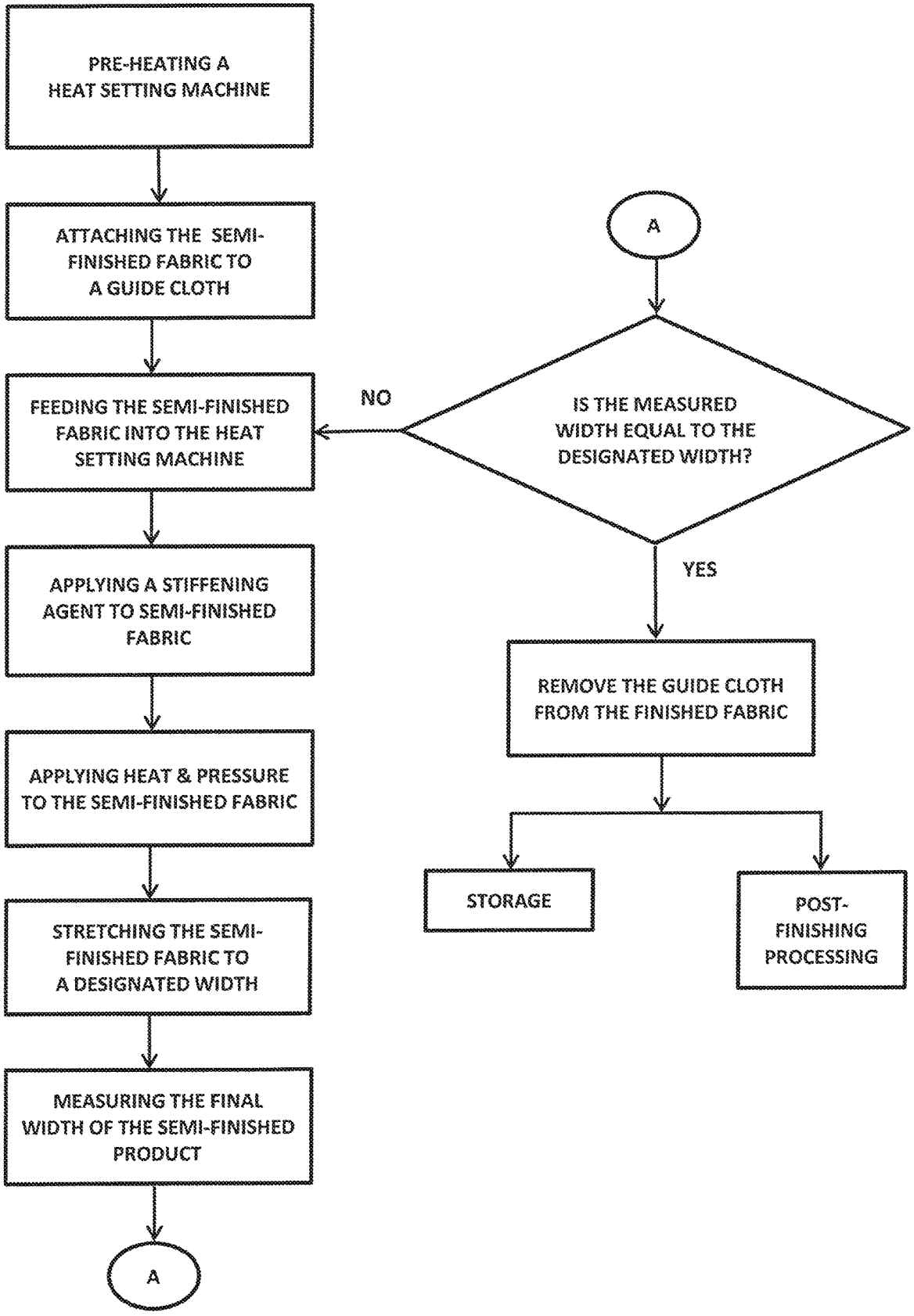
FIG. 6 is a schematic diagram showing the steps of the finishing process.
Figure 7:
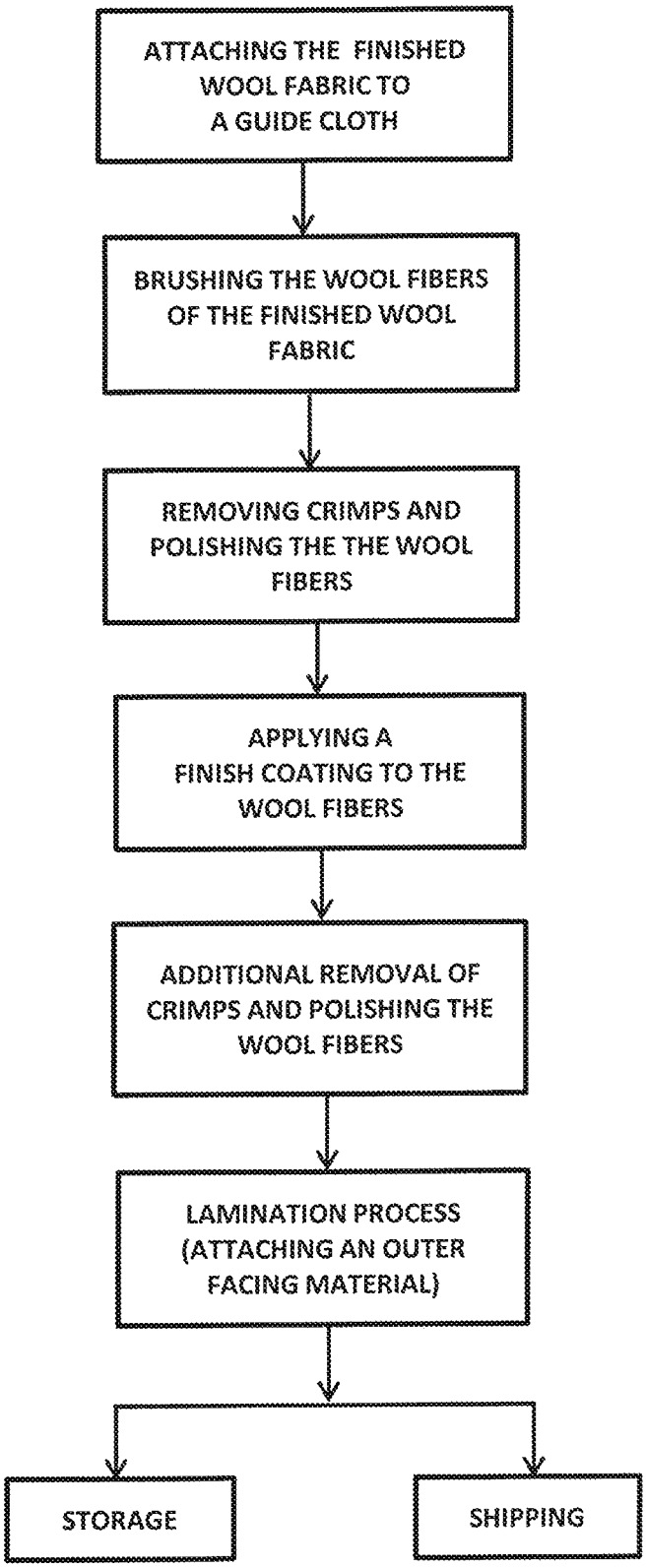
FIG. 7 is a schematic diagram showing the steps of the brushing process.
Figure 8:
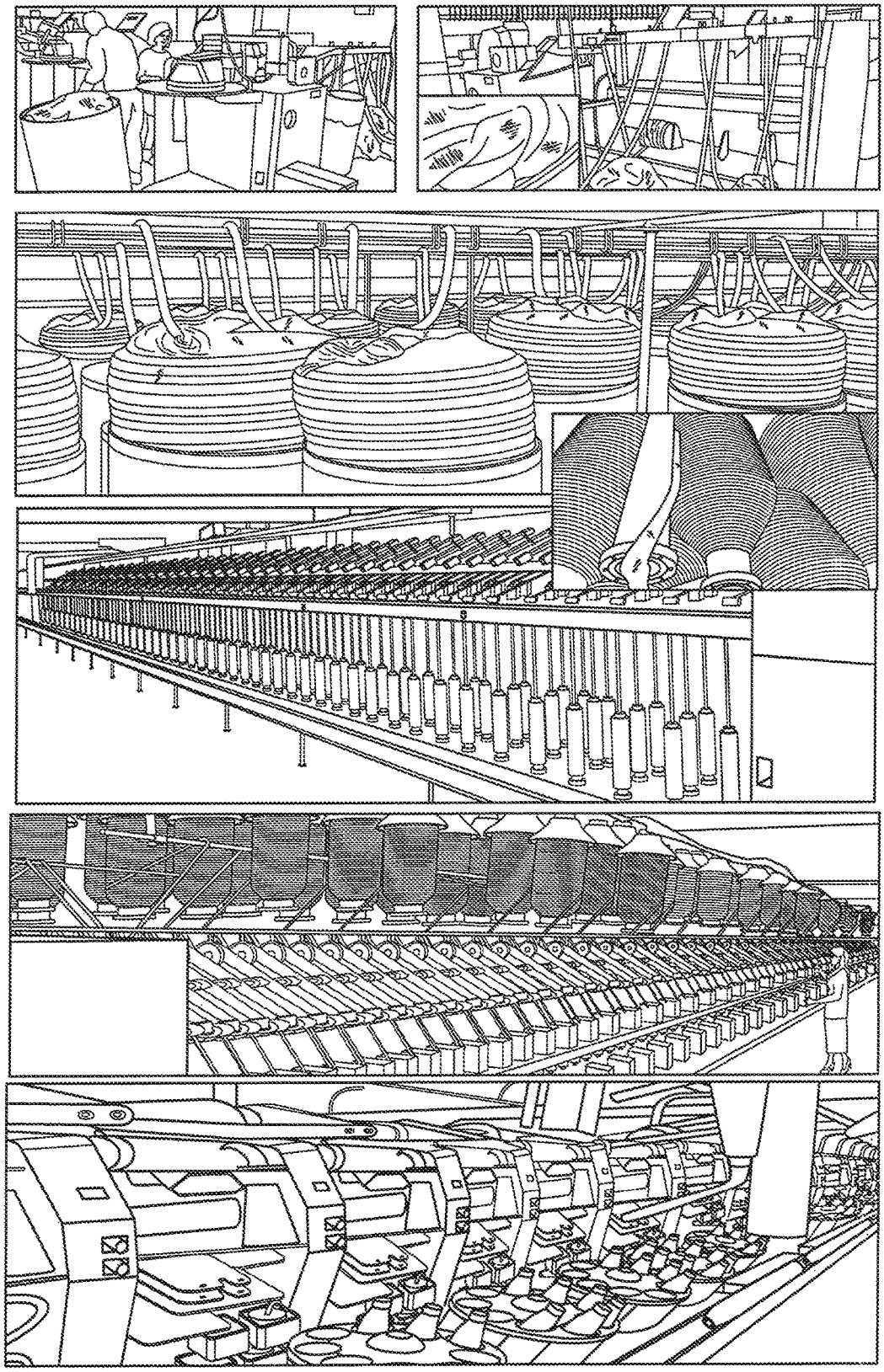
FIG. 8 are perspective views of the yarn fabrication machines.
Figure 9:
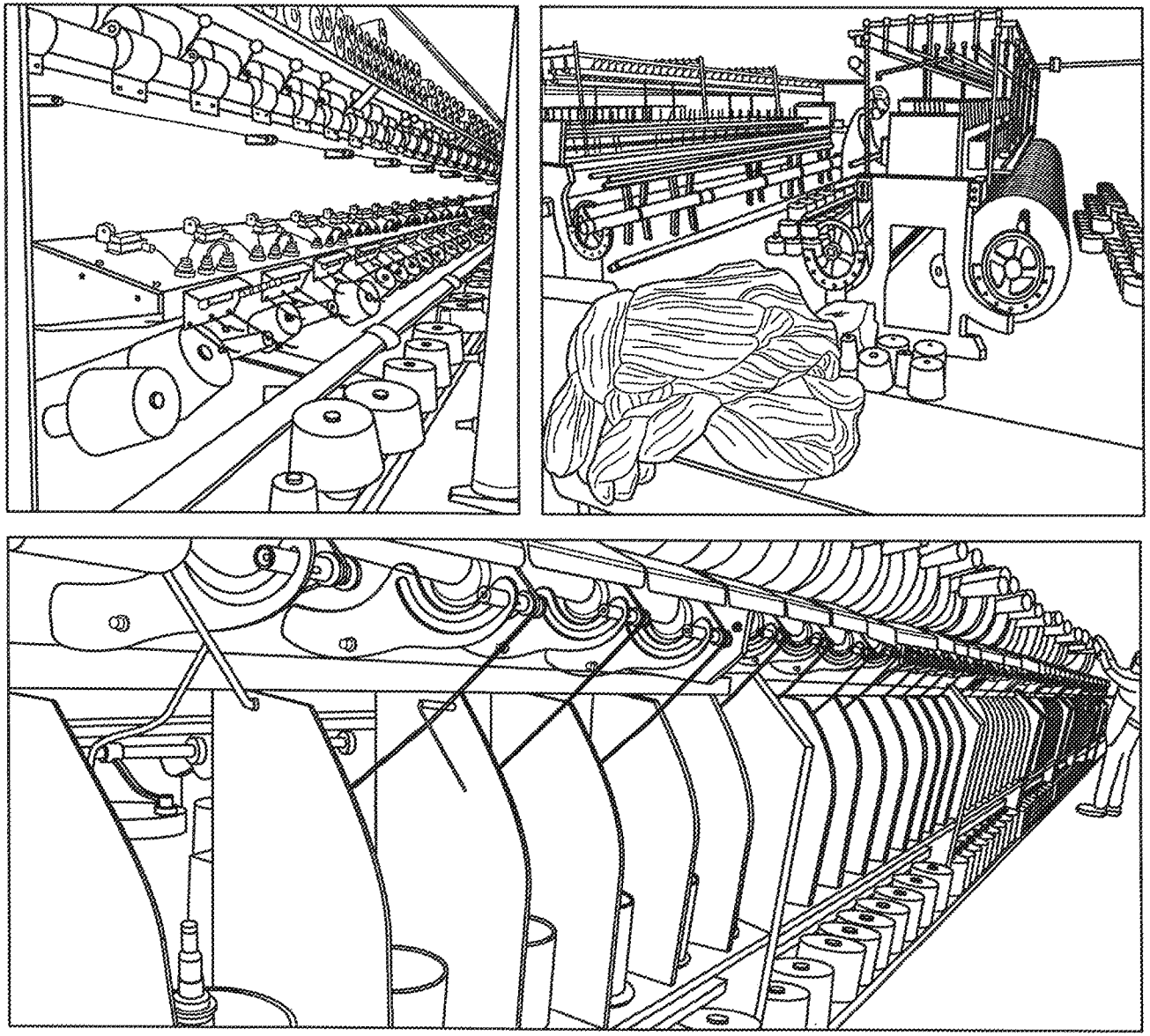
FIG. 9 are perspective views of the knitting machines.
Figure 10:
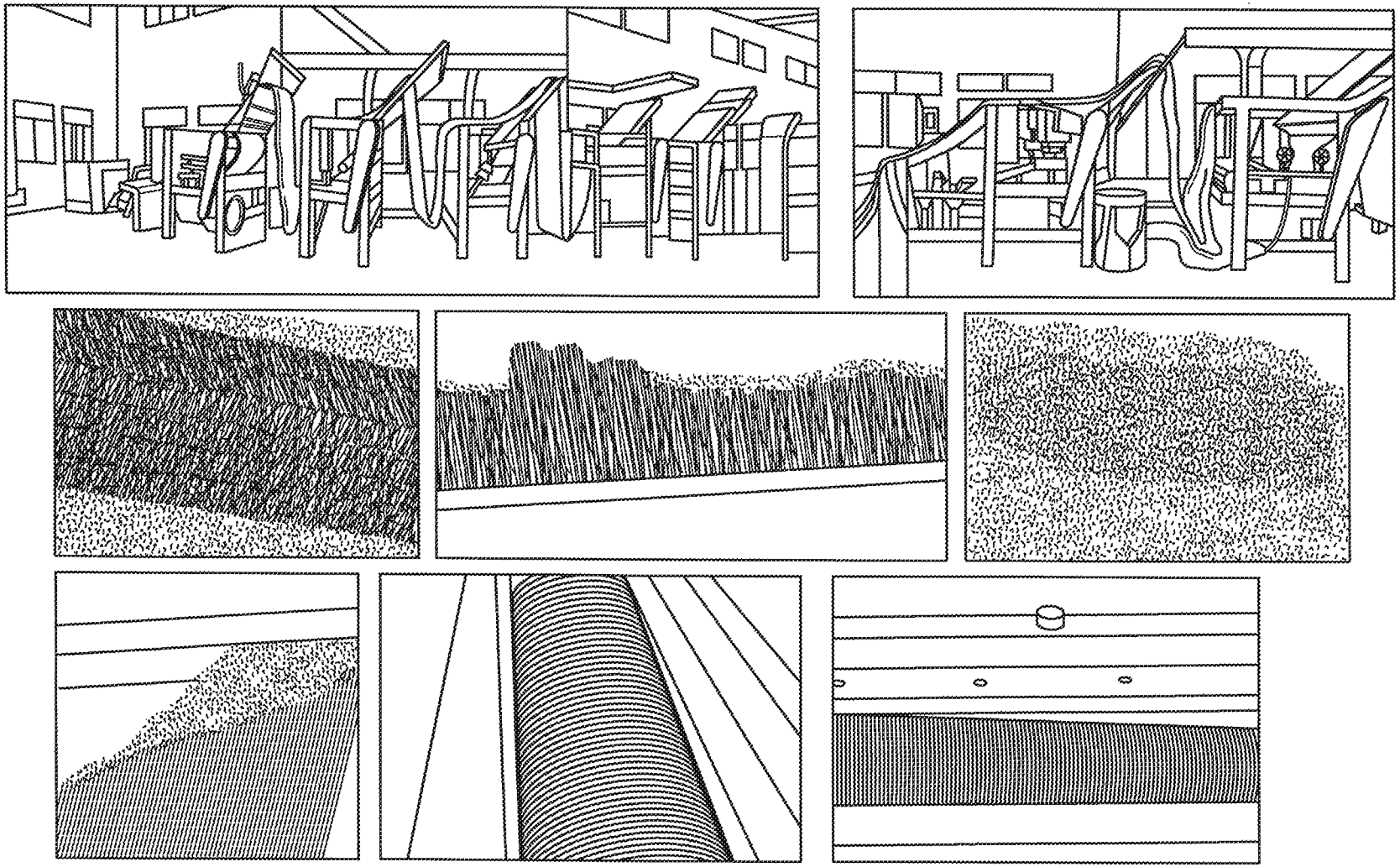
FIG. 10 are perspective views of the brushing machines.
Figure 11:
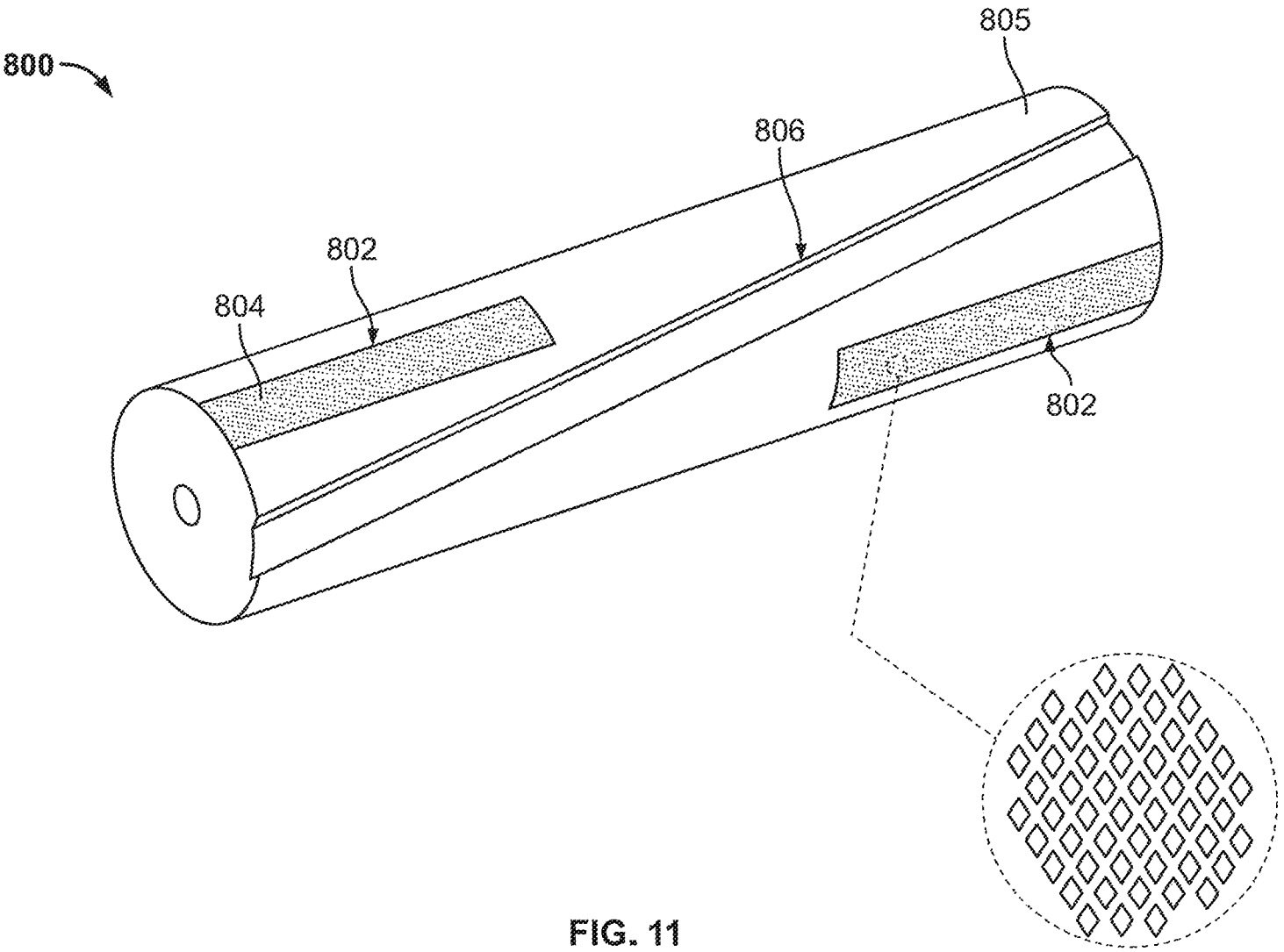
FIG. 11 is a perspective view of a polishing roll.

Referring to FIGS. 6 and 19, in the finishing process 2500, the semi-finished pile fabric is heated and stretched to a designated final width by one or more machines. In this embodiment, the semi-finished pile fabric is passed through a heat setting machine for stretching the semi-finished pile fabric to the designated or desired width. The heat setting machine includes a series of rollers and a frame portion to guide and move the semi-finished pile fabric adjacent to a coating applicator that applies a back side coating or stiffening solution including a stiffening agent to the scrim and then conveys the fabric through multiple ovens for curing or setting the coating. In one embodiment, the heat setting machine includes series of eight ovens. It should be appreciated that another suitable number of ovens may be used to dry and set the conditioning solution on the scrim.

Initially in a pre-heating step, the heat setting machine is activated and a plurality of the ovens are pre-heated to a predetermined preferred temperature of 140° C. and one or more ovens following the ovens are pre-heated to a predetermined preferred temperature of 114° C. It should be appreciated that the temperature of each of the ovens is in the range of about 140° to 165° C. during the heat setting process. It should also be appreciated that other suitable temperatures can be used depending on operating and ambient conditions provided that the temperature is not so hot so as to damage the semi-finished pile fabric. In this embodiment, the ovens are heated by steam.

When the ovens reach the respective predetermined temperatures, a guide cloth is temporally attached to the semi-finished pile fabric by an overlock stitching machine or other suitable stitching machine as described above and then fed into the heat setting machine. The guide cloth enables the operator to adjust the roller tension and the oven temperatures of the heat setting machine before the semi-finished pile fabric is fed through the machine to prevent unnecessary damage to and waste of the semi-finished pile fabric. In a coating step, at least one applicator roll applies a stiffening solution or agent to the scrim of the semi-finished wool product, as the semi-finished pile fabric is fed into the heat setting machine. A trough holds a bath of stiffening solution. Applicator roll is positioned at least partially in the trough. Roll rotates within trough and stiffening solution adheres to the outer surface of the roll. Roll contacts the scrim of the semi-finished pile fabric to apply the stiffening solution to the scrim. The stiffening solution fixes the knit structure of the scrim, helps bond the wool fibers within the scrim, and reduces the stretchability of the scrim and thereby the stretchability of the semi-finished pile fabric. In an embodiment, the stiffening solution is a light glue, which in one embodiment, is made of an impermeable stiffener (30%), a permeable stiffener (50%) and a polyacrylic emulsion (20%). It should be appreciated that the relative quantities of component ingredients may be adjusted depending on operating conditions. Also other agents may be added to the solution, and alternative stiffing solutions as known in the art as later developed can be used.

After the stiffening solution is applied, the semi-finished pile fabric is stretched, preferably using at least one and more preferably two metal rollers, each having a helical protrusion and groove. Steam is applied to the semi-finished pile fabric while stretching the product lengthwise, which narrows the width of the product from an initial width of about 1.9 m to a width in the range of 1.3 to 1.4 m. In this embodiment, the semi-finished pile fabric is fed through the heated rollers (heated to a temperature of about 140° C.) at a speed of about 8 m/min. The speed and temperature of the heated rollers may be adjusted as necessary to achieve a desired product width. An opposing series of rotating pins at least partially penetrate the edges of the fabric, simultaneously stretching the width of the fabric while guiding the fabric through the ovens to achieve a final width of 1.50 to 1.55 m.

After exiting the heat setting machine, the width of the wool pile fabric is measured as a final check in step. If the width is not within acceptable tolerance limits, the finished product is re-fed into the heat setting machine a second time and the above steps are repeated to further stretch the finished product to the desired final width. It should be appreciated that the semi-finished pile fabric may be coated with the stiffening solution and passed through the heat setting machine one or a plurality of times to achieve a finished product having the designated final width. When the finished product is at the designated final width, the guide cloth is removed and the finished product is either stored for future processing or transported to the post-finishing process.

As described above, at this stage, the wool fiber side of pile fabric is coarse and bristly, and generally unsuitable for use in many products including footwear and apparel where the wool fibers will come into contact with a wearer's skin. Therefore, the fabric is guided through a post-finishing process that enhances the softness and straightness of the fibers on the fiber side of the fabric as well as cuts the fibers to a desired length. Referring to FIGS. 19 and 22-27, in a post-finishing process 2600, the wool pile fabric is fed through a series of post-finishing machines. Initially, the wool pile fabric is fed through three brushing machines (each being the same as the brushing machine shown in FIG. 10) at a rate of 2.5-3.0 meters per minute. The brushing machines each include fixed guides 2602 and rotating guide rollers 2604 that guide the fabric through the brushing machine, and at least two brush rollers 2606 that rotate in opposite directions and brush the coarse wool fibers of the wool pile fabric to straighten and brush out the wool fibers to replicate natural fleece.

After exiting the brushing process (i.e., the sequence of three brushing machines), the wool pile fabric goes through one, or a plurality of polishing steps to soften, comb and enhance the luster of the wool fibers. Similarly, the fabric is fed through one or more shearing machines to cut the length of the wool fibers to a designated final length. The polishing and shearing steps are performed by one or more machines. In this embodiment, after exiting the brushing process, the wool pile fabric is fed through a polishing and shearing station 2608 that includes a shearing machine 2610, a coating machine 2612 and a single polishing roll machine 2614, a double polishing roll machine 2616, a second polishing and shearing station and a third polishing and shearing machine stations where the second and third polishing and shearing stations are the same as the first polishing and shearing station 2608. The designated sequence of the machines is to soften and straighten the fibers on the fiber side of the wool pile fabric while cutting the fibers to a desired final length. The following paragraphs describe each of the machines in the finishing process for this embodiment. It should be appreciated that the number and sequence of the machines may change based on the desired properties and dimensions for the final product.

Figure 23:
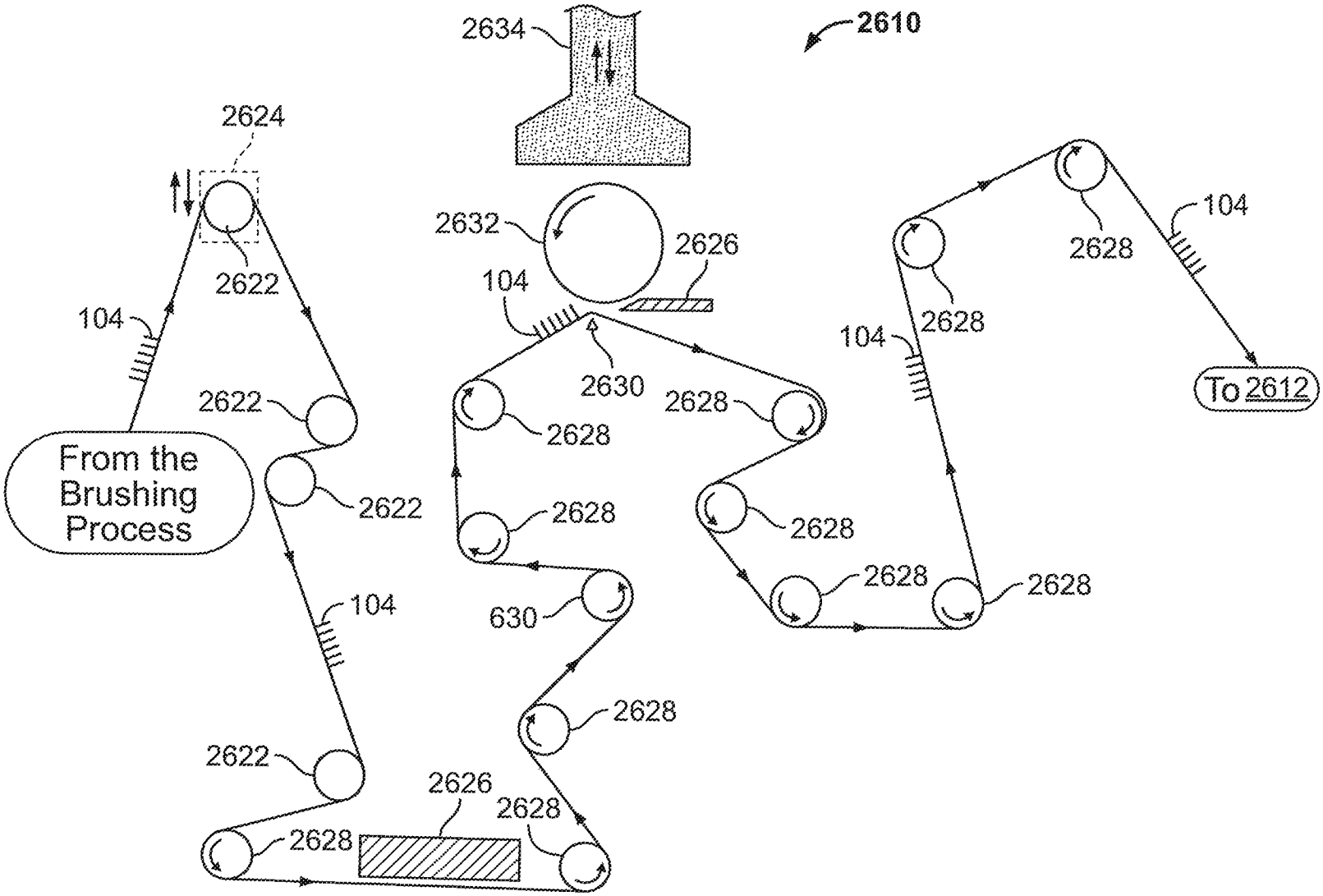
FIG. 23 is a schematic diagram showing an embodiment of a shearing machine of a shearing and polishing station that cuts the wool pile fibers.

Referring to FIG. 23, the fabric is guided through the first polishing and shearing station 2608 to ensure the consistency and uniformity of the length of wool fibers 104. As shown in FIG. 23, the shearing machine 2610 includes a series of guides 2622, a pivoting guide 2624 for aligning the wool pile fabric, a frame portion 2626, guide rollers 2628 and a nip 2630 for guiding and moving the fabric through the machine. Initially, the fabric is guided over a shearing roll 2632 that cuts the fibers to an intermediate length. An exhaust hood 2634 is positioned over the shearing roll 2632 to collect the cut ends of the fibers. After the wool fibers are cut or sheared, the fabric is guided by a series of guide rollers 2628 to the coating machine 2612.

Figure 24:
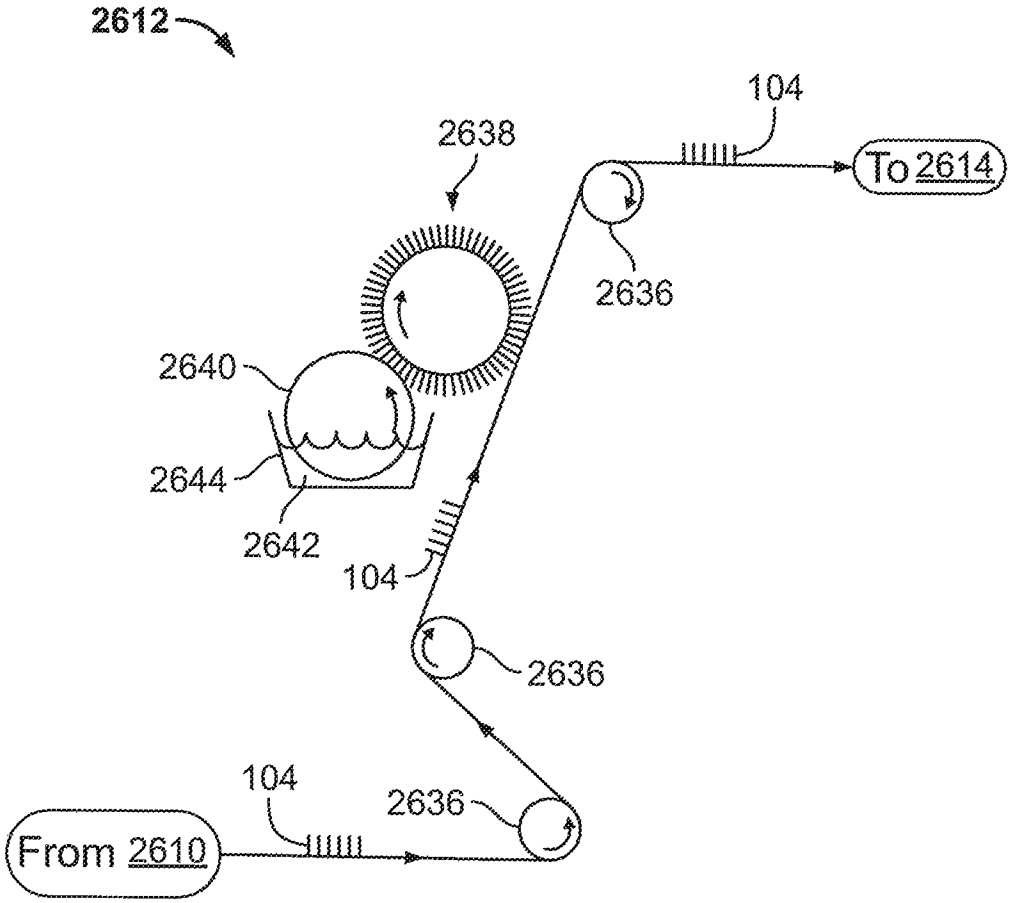
FIG. 24 is a schematic diagram showing an embodiment of a coating machine of a shearing and polishing station that applies a conditioning solution to the fibers.

As shown in FIG. 24, a coating is applied to the wool fibers by a coating machine 2612. The coating machine 2612 includes a series of guide rollers 2636 and a coating applicator roll 2638 having an outer brush surface. The applicator roll 2638 is positioned adjacent to a metering roll 2640 which transfers a finish coating 2642 from trough 2644 to the applicator roll. The finish coating may be any suitable coating as described above that conditions and softens the wool fibers. It should be appreciated that the coating machine 2612 may include one or more metering rolls 2640 and coating applicator rolls 2638 to apply a desired volume or coating weight to the wool fibers 104 of the wool pile fabric. After the coating process, the fabric is directed to a single polishing roll machine 2614.

Figure 25:
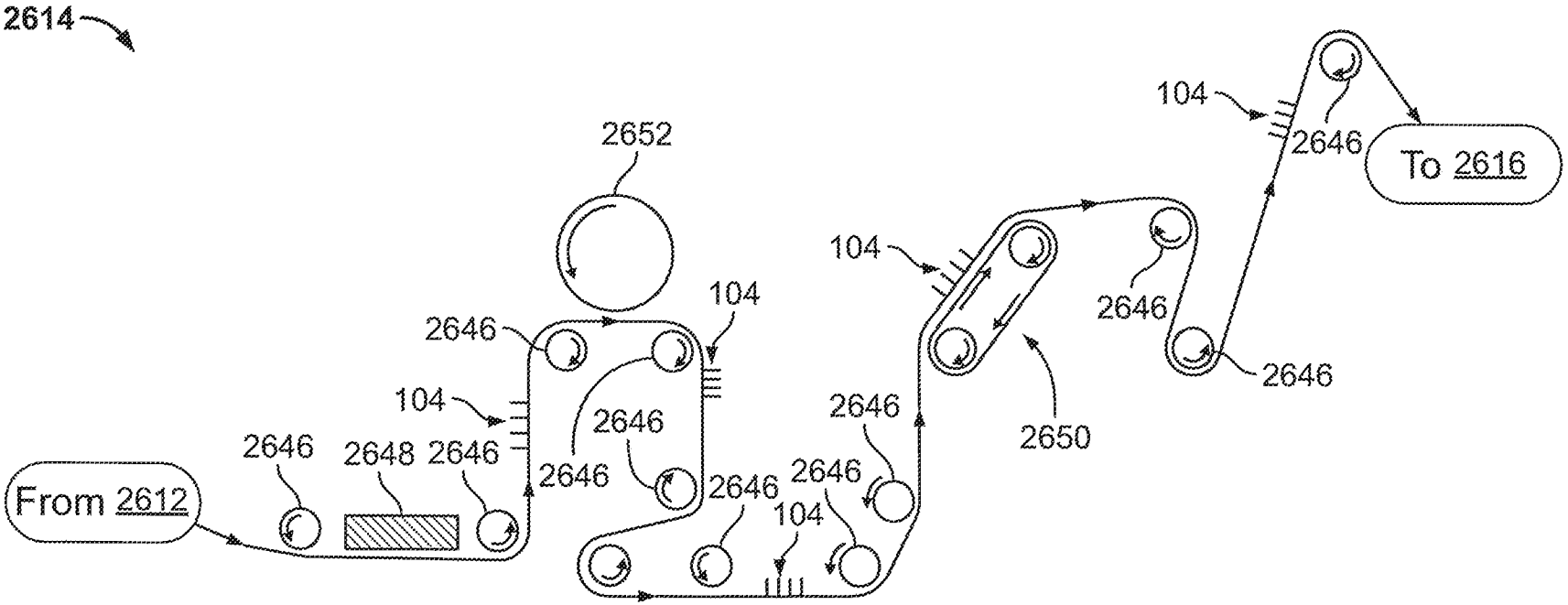
FIG. 25 is a schematic diagram showing an embodiment of a coating machine of a shearing and polishing station that applies a conditioning solution to the fibers.

After the finish coating 2642 is applied to the wool fibers 104 of fabric, the wetted fabric is guided or fed through a single polishing roll machine 2614 shown in FIG. 25 to force the coating toward the base of the wool fibers, to further remove any remaining crimping on the wool fiber ends and to polish the fiber ends. In the illustrated embodiment, the fabric is fed through the single polishing roll machine by a series of guide rollers 2646, a portion of the frame 2648 and a rotating belt 2650. A heated polishing roll 2652 is positioned adjacent to the fiber side of the fabric and polishes the fibers as described above. In the present embodiment, the feed rate of the fabric 102 through the single polishing roll machine is 2.0-3.0 m/min and the temperature of the polishing roll 2652 is about 200° C. Also, the rotational speed of the polishing roll 2652 is about 840 rpm. It should be appreciated that the feed rate and the temperature and rotational speed of the polishing roll 2652 may be adjusted as necessary to achieve a desired finish of the wool fibers on the fabric.

Figure 26:
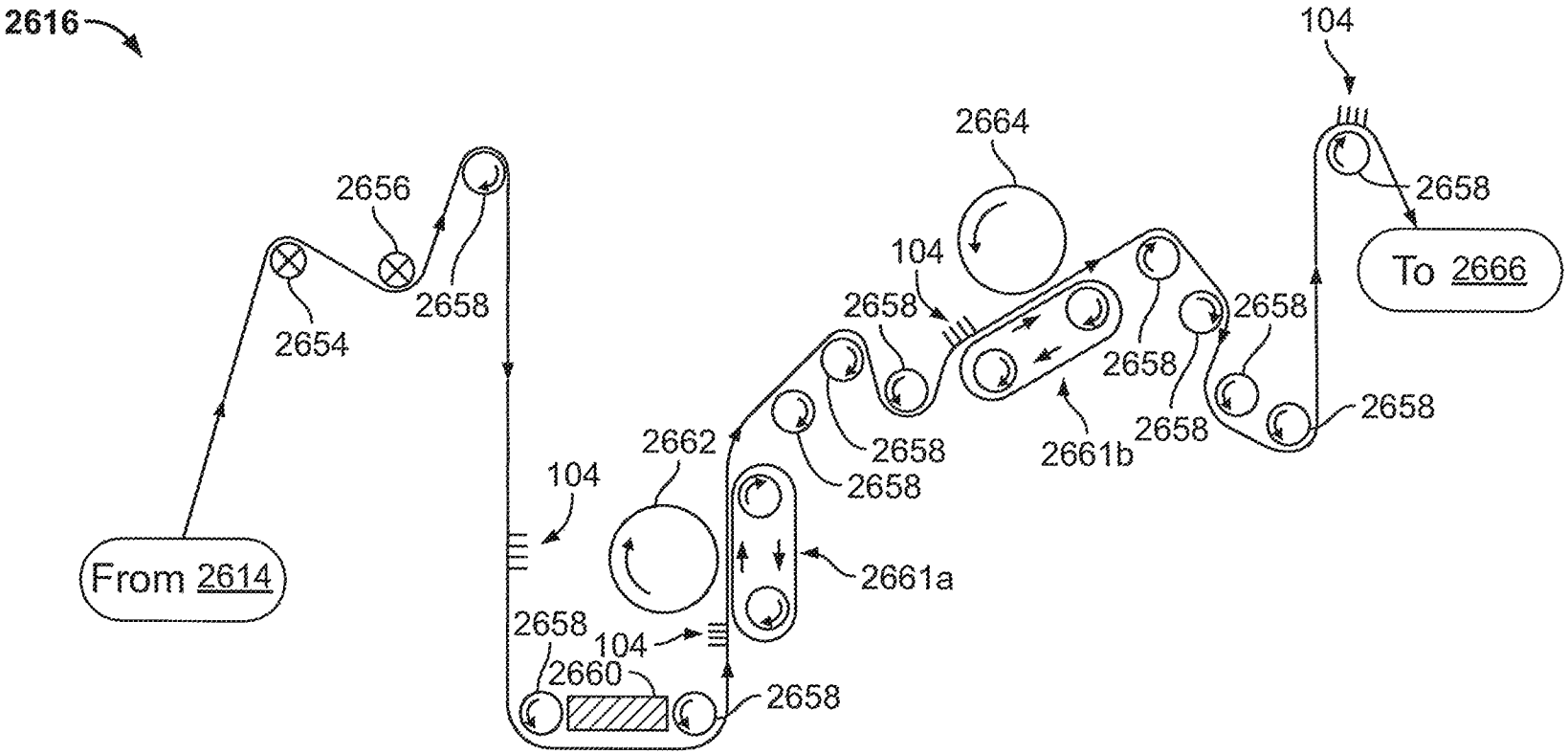
FIG. 26 is a schematic diagram showing an embodiment of a double polishing roll machine used in the post-finishing process.

Next, the fabric is guided through a double polishing roll machine 2616 shown in FIG. 26. The double polishing roll machine 2616 includes a series of stationary guides 2654 and 2656, guide rollers 2658, a frame portion 2660 and two rotating belts 2661*a*, 2661*b* that guide and convey the wool pile fabric and more specifically, the wool fibers 104 of the finished fabric against two independent, heated polishing rolls 2662 and 2664. In this embodiment, each polishing roll 2662, 2664 operates at about 840 rpm, a first roll 2662 rotates in a direction opposite to the direction of travel of the length of fabric, while a second roll 2664 rotates in the same direction of travel as the fabric. The polishing rolls 2662, 2664 rake the wool pile side (wool fibers 104) of the fabric to remove crimps from the ends of the wool fibers and frictionally engage and thereby initially polish and comb the wool fibers. The different direction of rotation of the rolls 2662, 2664 helps avoid a directional lay of the wool fibers 104. In the present embodiment, the feed rate of the wool pile fabric through the double polishing roll machine 2616 is about 2.0-3.0 m/min and the temperature of the first and second polishing rolls 2662, 2664 is 170° C. to 190° C. It should be appreciated that the polishing rolls 2662, 2664 may be set at a temperature sufficient to polish the wool fibers 104 of the pile fabric but not so hot as to damage the fibers.

After the double polishing roll machine, the fabric is guided through a second shearing and polishing station and a third shearing and polishing station, where the second and third stations are the same as the first shearing and polishing station 2608 described above and shown in FIGS. 23-25. As such, the construction and operation of the second and third shearing and polishing stations will not be repeated. During operation, the second and third shearing and polishing stations further cut the fibers on the fiber side of the fabric to a final desired length. Also, the heated polishing rolls of these machines further polishes and straightens the fibers 104 to enhance the softness, look and feel of the fabric.

Figure 27:
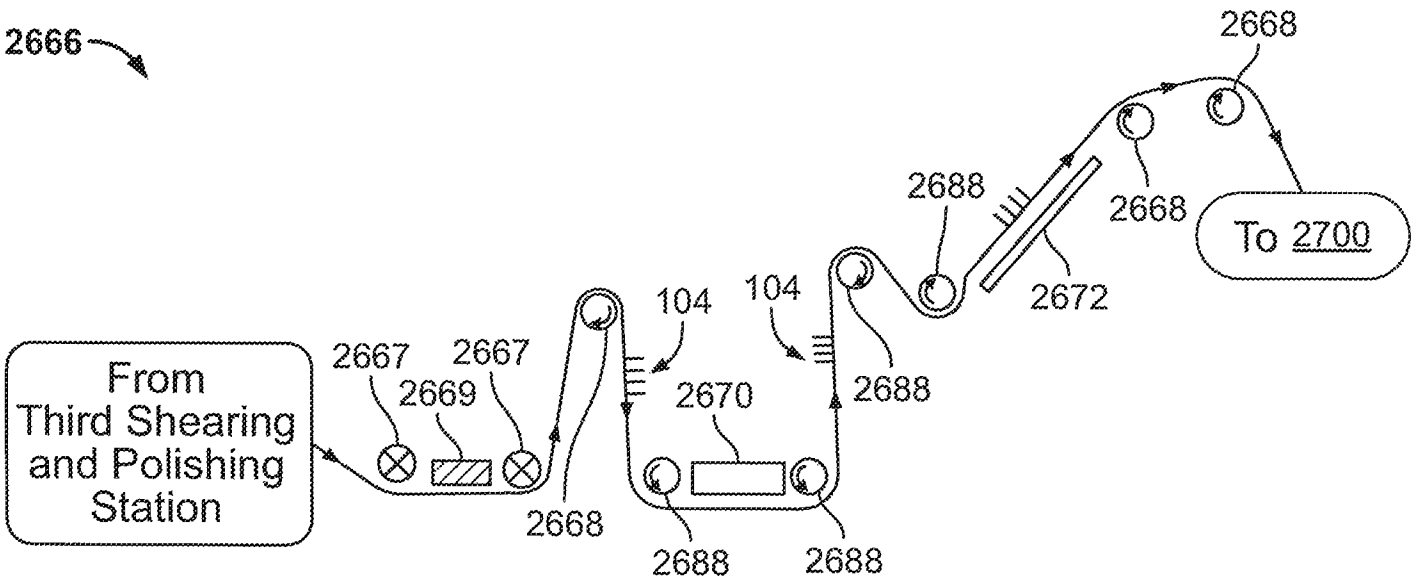
FIG. 27 is a schematic diagram showing an embodiment of a metal inspection machine used in the post-finishing process.

After the post-finishing process is finished, the wool pile fabric is transported to a metal inspection machine 2666 shown in FIG. 27. This machine guides the fabric using fixed guides, 2667, guide rollers 2668, a portion of the frame 2669 and past a metal detector device 2670 positioned adjacent to the fabric that is at least as wide as the fabric and configured to detect metal or metal objects in the fabric, such as staples, pins and other metal that may be caught in the fibers 104 of the fabric. The metal detector device 2670 is calibrated to detect a metal objects having a size of 1.5 mm or greater. A series of light-emitting diodes (LEDs) are on the metal detector device 2670 and illuminate when a metal object is detected. Only the LED or LEDs near the position of a metal object on the fabric illuminate to indicate the approximate location of the metal object for removal. If no metal objects are detected on the fabric, then the LED(s) do not illuminate. After passing the metal detector device 2670, the fabric is guided over a planar metal plate 2672 to further visually check the fabric and scrim for holes, dirt and other abnormalities. If detected, the holes/abnormalities are repaired and the dirt is cleaned if possible.

After the metal inspection machine, the fabric is transported to the storage and shipping process 2700, where the fabric is stored in a storage area or transported to a shipping area for packaging and shipping to another location such as a distributor, or end product manufacturer, such as a footwear manufacturer.

In the above embodiments, the yarn knitting process is preferably used to make a wool pile fabric with wool fibers having a height or length of 12 mm or less. When the wool fibers are greater than 12 mm, there is a greater loss of the wool fibers during the brushing process than with a pile fabric having shorter fibers, i.e., 12 mm or less. Furthermore, the yarn knitting process is an improvement over sliver knitting processes because shorter pile (wool fiber) heights (less than or equal to 12 mm) are achievable without sacrificing wool density as occurs with sliver knitting and other similar knitting processes. Also, employing the yarn knitting process saves significant cost over sliver knitting and other knitting processes, where the cost savings is in a range of $1.70 USD to $6.00 USD per meter of pile fabric. Regarding yarn knitting using cashmere yarn, the cost savings is $25 USD per meter of pile fabric.

As described above, the DTY yarn or the finished wool pile fabric product or wool pile fabric piece can be dyed. Dyeing the finished wool pile fabric product has a lower cost, is convenient and has a quicker turnaround time. Also, stocks of non-dyed pile fabric can be stored and dyed at a later time to accommodate specific requests. However, there is less control over the color. Alternatively, dyeing the DTY yarn allows for easier control of the color but with higher cost and at a slower production rate.

In footwear applications, the pile fabric could be engineered in such a way that patterns with varying heights of wool or channels could be strategically knit to help with thermal regulation. The varying wool heights could provide added comfort against the foot or act as an "engineered structure." A shorter pile height would also allow for a sleeker shoe shape without sacrificing warmth. In a stretchable form, the pile fabric could potentially act as the closure system for the shoe. In addition to footwear, the pile fabric can be used to make apparel, accessories (socks, gloves, bags) and home goods.

Additionally, the pile fabric can be used in footwear as a lining to the upper or cover on the footbed. Potentially, the pile fabric could be used as the upper of an article of footwear with the wool fiber side turned inside or out. On a stretch backer or backing material, the pile fabric could be used as a boot shaft or sock or potentially a closure system for footwear. In apparel/accessories, the pile fabric could be used as a thermal lining for jackets, sweaters, hats, gloves, robes, etc. Potentially, the pile fabric could be cut and sewn as sweaters, socks or other garments. In home goods there are potential applications in blankets, carpets, floor mats, pillows, seat coverings, etc.

While particular embodiments of the present method have been described herein, it will be appreciated by those skilled in the art that changes and modifications may be made thereto without departing from the invention in its broader aspects.

The invention claimed is:

1. A method of making a sheared wool, deep pile fabric that closely resembles natural sheepskin fleece, comprising, forming a yarn made from wool fibers;

knitting the yarn to form a pile fabric and knitting a scrim to form a base, while simultaneously knitting the yarn and the scrim together, wherein the yarn is attached to and extends from the scrim to form a length of wool pile fabric having natural wool fibers on one side and the scrim on an opposing side, and finishing the wool pile fabric as natural sheepskin, including, polishing the wool fiber side of the pile fabric by guiding the length of pile fabric over plural heated polishing rolls, wherein at least two of the plural heated polishing rolls rotate in opposite directions, and cutting the wool fibers to a designated length.

2. The method of claim 1, wherein at least one of the plural heated polishing rolls comprises a plurality of blades, each blade having a multiplicity of teeth for raking the wool fiber side of the fabric.

3. The method of claim 1, wherein each of the polishing rolls comprises a plurality of blades, each blade having a multiplicity of teeth for raking the wool fiber side of the fabric.

4. The method of claim 1, wherein the polishing step is performed with a first set of plural heated polishing rolls and a further polishing step is performed by a second set of plural heated polishing rolls.

5. The method of claim 1, further comprising cutting the wool fibers to an intermediate length prior to cutting the wool fibers to the designated length.

6. The method of claim 1, wherein the yarn is treated during the finishing step by applying a mixing solution to the yarn.

7. The method of claim 6, wherein the mixing solution comprises a mineral oil, an anti-static agent and water.

8. A method of making a sheared wool pile fabric comprising:

knitting a yarn made with sheared wool fibers and knitting a textile scrim while simultaneously knitting the yarn and the textile scrim together, to produce a length of wool pile fabric having a wool fiber pile on one side and the textile scrim on an opposing side, rough shearing the wool fiber side of the fabric to a first predetermined length of the wool fibers, applying a polishing coating to the wool fiber side of the fabric, polishing the wool fiber side by passing the fabric over at least two heated polishing rolls, and fine shearing the wool fiber side of the fabric to a second predetermined length of the wool fibers.

9. The method of claim 8, wherein the rough shearing, applying, polishing and fine shearing steps are performed in an automated, substantially continuous process on the length of fabric travelling at a speed of at least 2 meters per minute.

10. The method of claim 8, wherein the step of producing the wool pile fabric comprises forming a continuous tubular piece of fabric and slitting the tubular piece of fabric to form said length of wool pile fabric.

11. The method of claim 8, further comprising a step of applying a back side coating to the textile scrim before the polishing step, the back side coating including a stiffening agent.

12. The method of claim 8, further comprising an initial polishing step of passing the wool fiber side of the fabric over a first set of heated double polishing rolls, followed by passing the wool fiber side of the fabric over a second set of heating double polishing rolls.

13. The method according to claim 8, wherein in the polishing step the rolls are heated to at least 170 degrees C.

14. The method of claim 8, wherein the fine shearing step comprises passing the fabric through at least one combined polishing and shearing machine.

15. A method of making a wool fleece product comprising:

providing a yarn comprised of sheared wool fibers, knitting the yarn and knitting a textile scrim while simultaneously knitting the yarn and the scrim together, to form a length of semi-finished wool pile fabric having a wool pile on one side and the textile scrim on an opposing side, rough shearing the wool pile side of the fabric to a first length of the wool fibers, polishing the wool pile side by passing the fabric through a first set of at least two polishing rolls heated to at least 170 degrees C., applying a polishing coating to the wool pile side of the fabric, polishing the wool pile side by passing the fabric through a third polishing roll heated to at least 170 degrees C., shearing the wool pile side of the fabric to a second wool fiber length, wherein the second wool fiber length is less than the first wool fiber length, polishing the wool pile side by passing the fabric through at least one additional polishing roll heated to at least 170 degrees C.; and shearing the wool pile side of the fabric to a final wool fiber length, wherein the final wool fiber length is less than the second wool fiber length.

* * * * *